US006053246A

United States Patent [19]

Echols et al.

[11] Patent Number: 6,053,246

[45] Date of Patent: Apr. 25, 2000

[54] HIGH FLOW RATE FORMATION FRACTURING AND GRAVEL PACKING TOOL AND ASSOCIATED METHODS

[75] Inventors: Ralph H. Echols, Dallas; Philip T. Thomas, Lewisville, both of Tex.

[73] Assignee: Halliburton Energy Services, Inc., Dallas, Tex.

[21] Appl. No.: 08/914,352

[22] Filed: Aug. 19, 1997

[51] Int. Cl.[7] ..... E21B 43/04

[52] U.S. Cl. ..... 166/278; 166/51; 166/205

[58] Field of Search ..... 166/278, 51, 205, 166/157, 158, 242.7

[56] References Cited

U.S. PATENT DOCUMENTS 1,907,862 5/1933 Pearce ..... 166/158

5,343,949 9/1994 Ross et al. ..... 166/278

5,762,137 6/1998 Ross et al. ..... 166/205

*Primary Examiner*—David Bagnell

*Assistant Examiner*—Chi H. Kang

*Attorney, Agent, or Firm*—Paul I. Herman; Marlin R. Smith

[57] ABSTRACT

A formation fracturing and gravel packing tool and associated methods provide high flow rates and volumes of slurry delivery in a relatively small bore well. In a described embodiment, a formation fracturing tool has a telescoping travel joint and a washpipe within an assembly including a packer, a circulating sleeve and a screen. The packer is set in the well, the travel joint is extended, the travel joint is locked in its extended configuration, a slurry is flowed through the circulating sleeve, the extended travel joint is latched onto the washpipe, and the travel joint and washpipe are retrieved to the earth's surface.

42 Claims, 29 Drawing Sheets

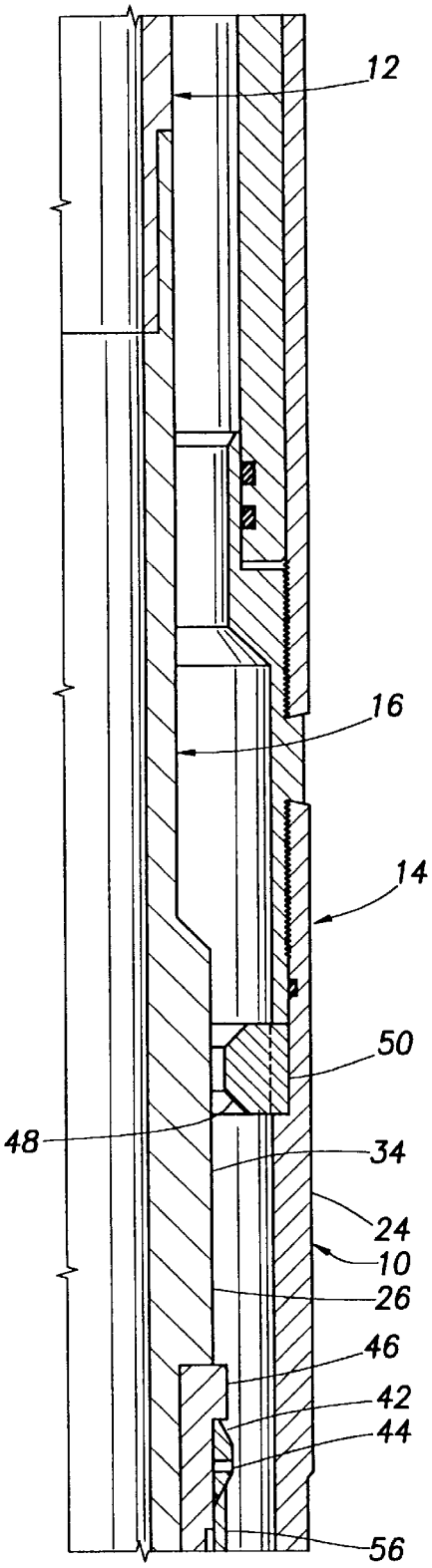
FIG. 1G
FIG. 1H
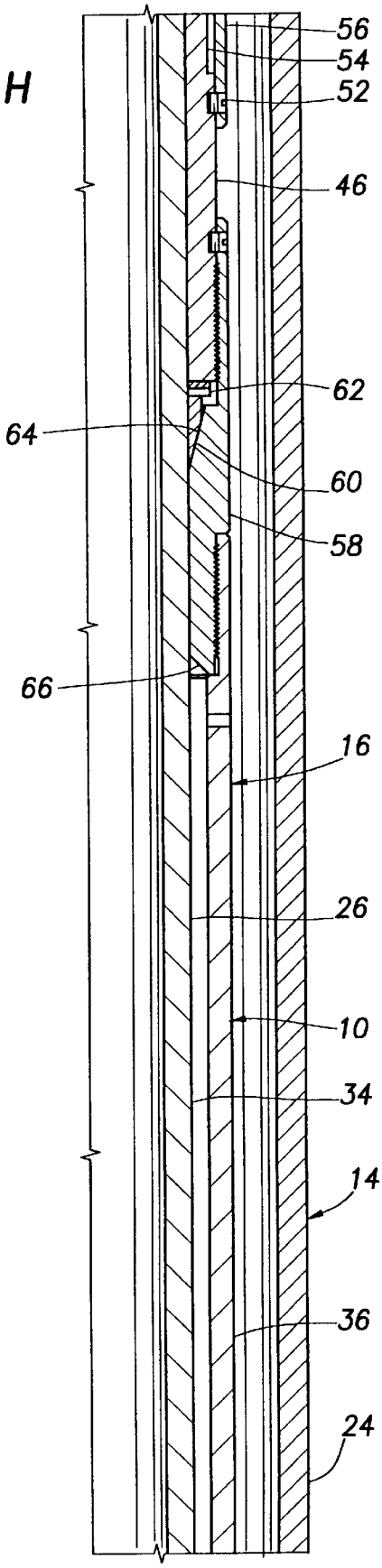

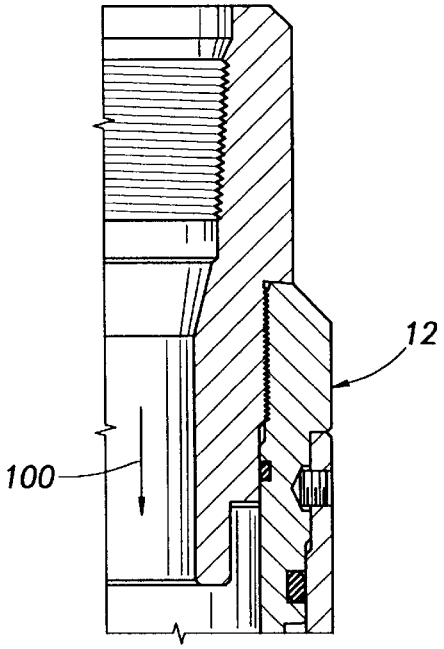
FIG.2A
FIG.2B
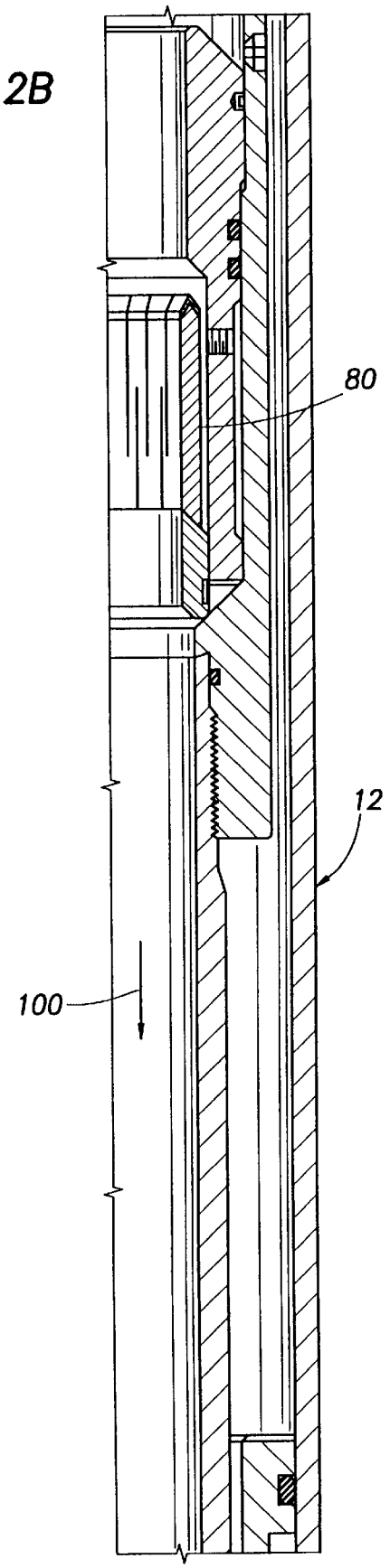

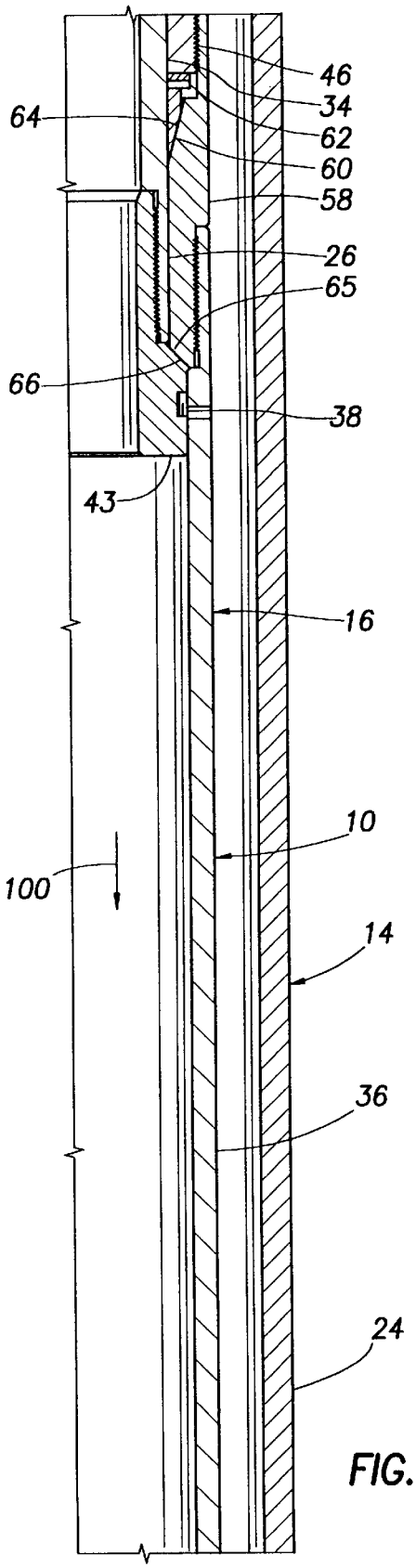
FIG.2I
FIG.2J
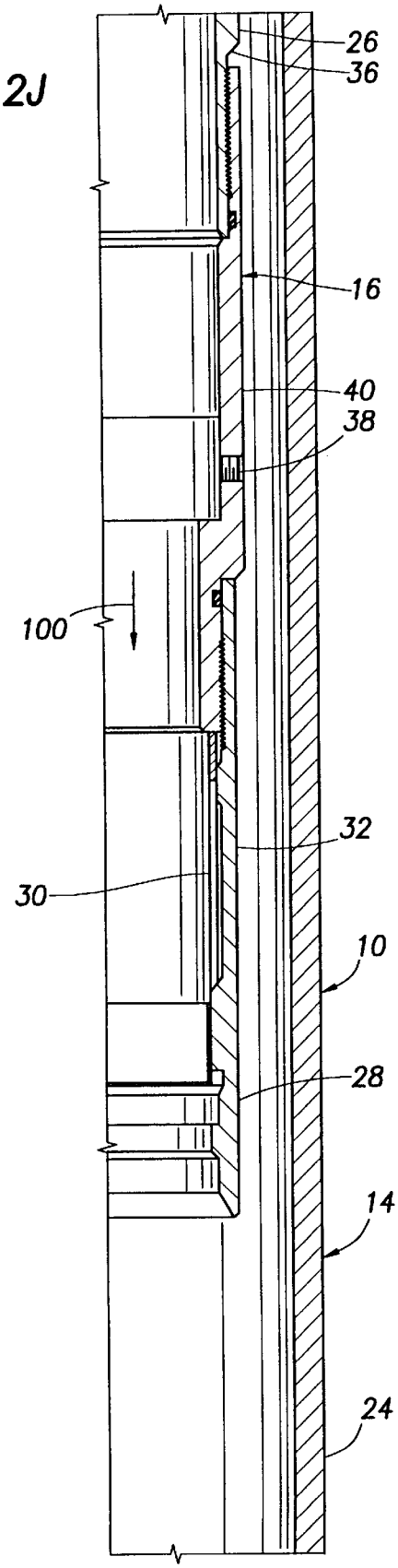

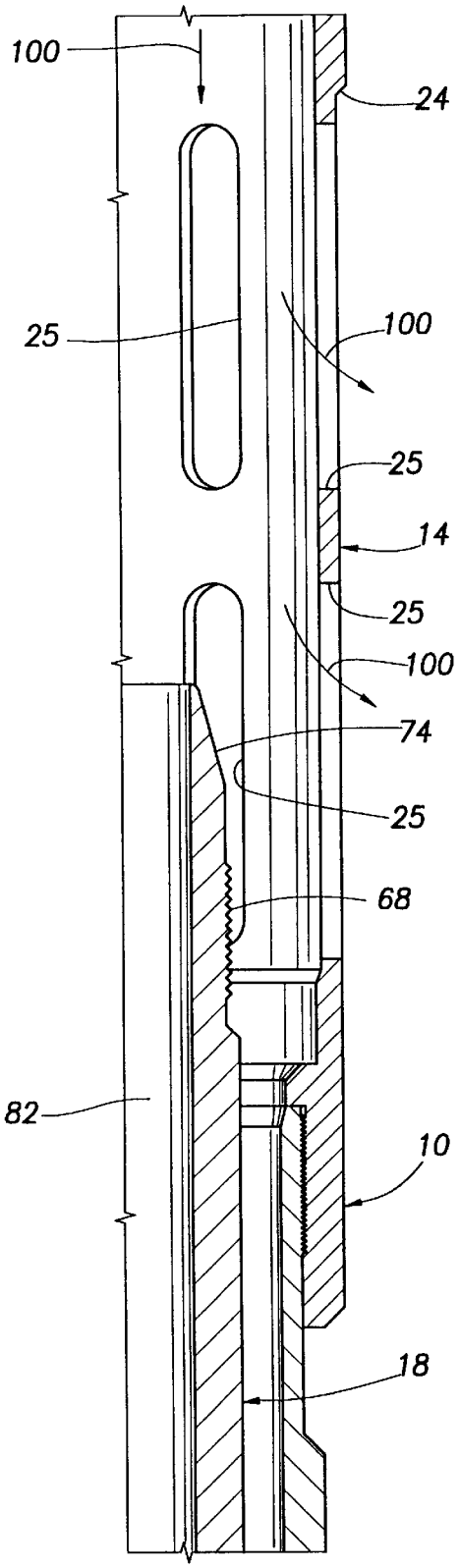
FIG.2K
FIG.2L
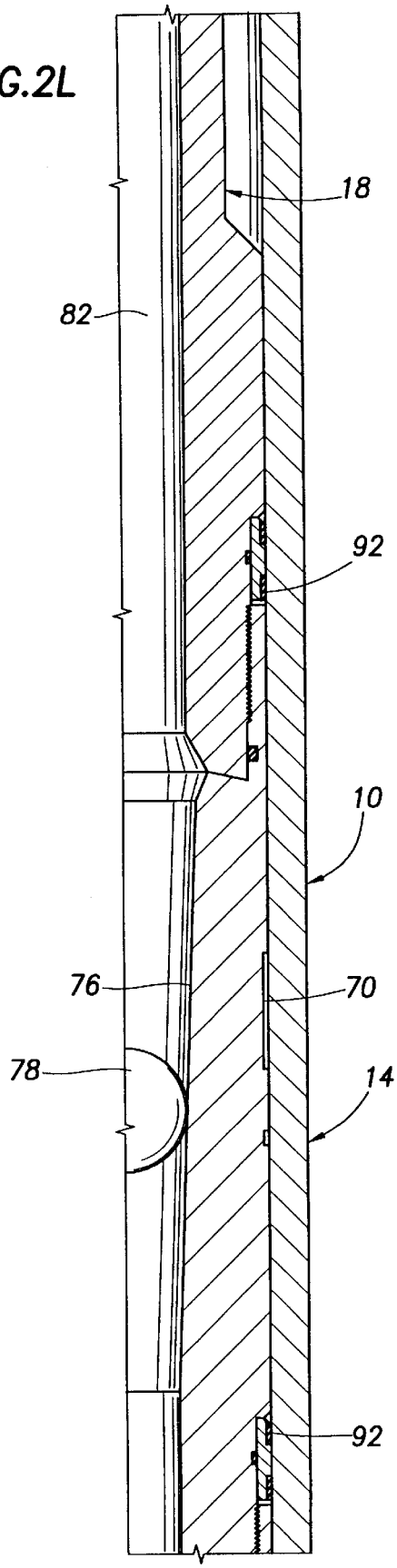

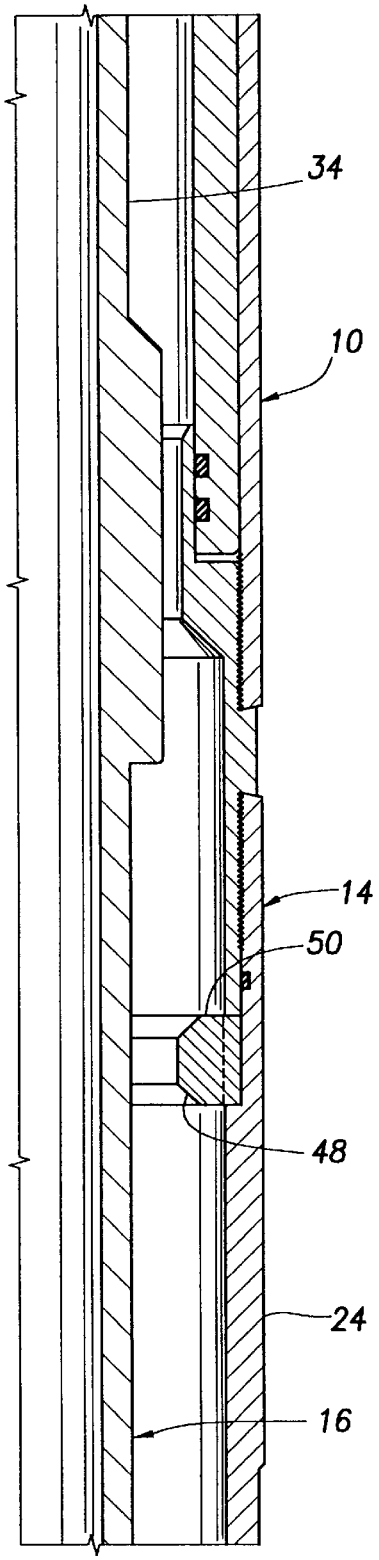
FIG.3G
FIG.3H
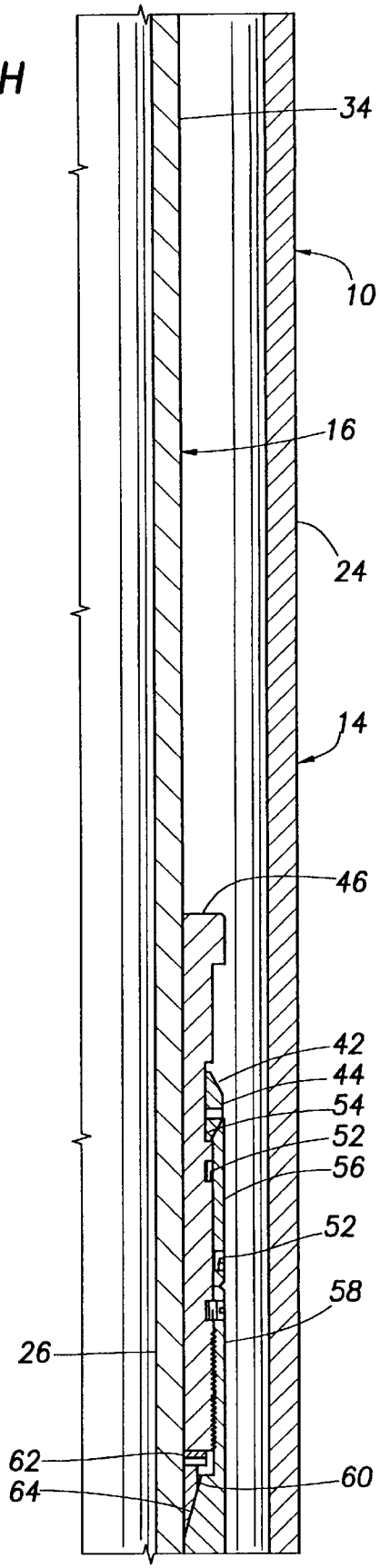

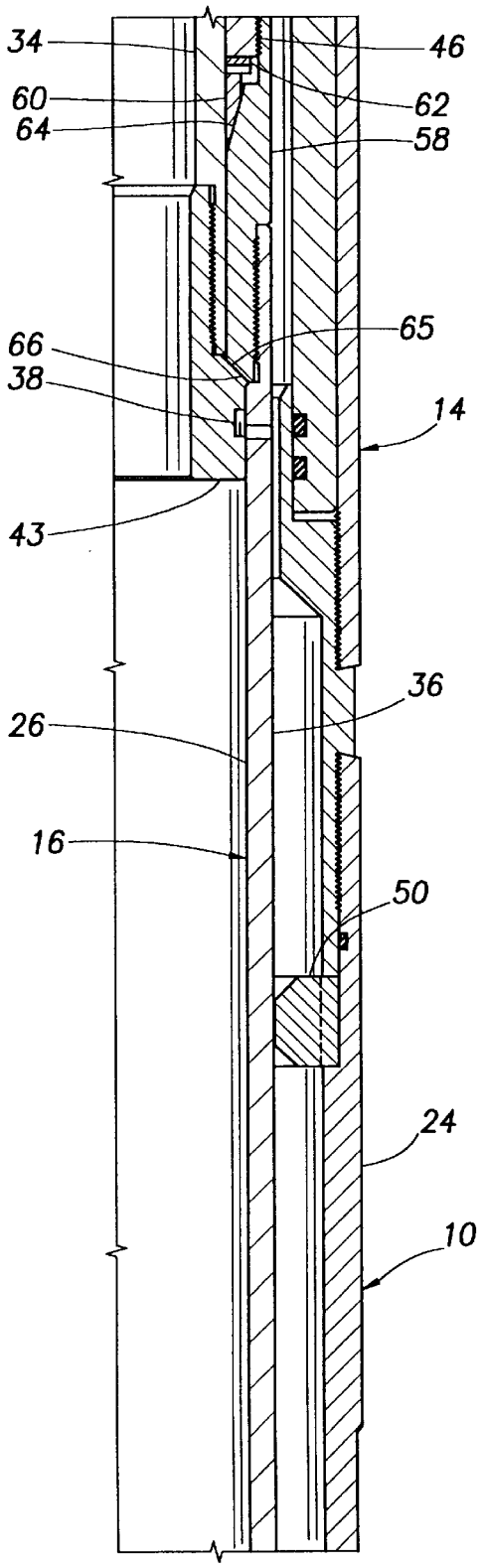
FIG. 4I
FIG. 4J
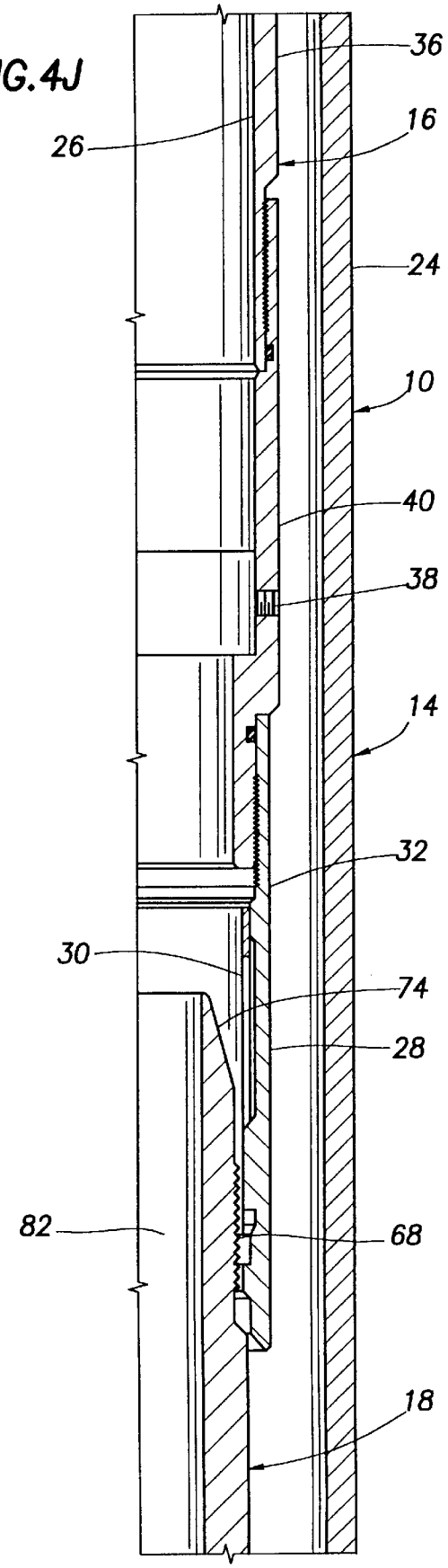

HIGH FLOW RATE FORMATION FRACTURING AND GRAVEL PACKING TOOL AND ASSOCIATED METHODS

BACKGROUND OF THE INVENTION

The present invention relates generally to formation fracturing and gravel packing operations performed in subterranean wells and, in an embodiment described herein, more particularly provides a formation fracturing and gravel packing tool and associated methods for high flow rate slurry delivery.

Formation fracturing and gravel packing operations continue to utilize ever higher flow rates and volumes of slurry delivery. In typical operations, these high flow rates and volumes are detrimental to equipment used in the operations, since the slurries are usually very abrasive. This equipment abrasion has been mitigated in some instances by providing thicker cross-sections in the equipment, increasing flow area to reduce slurry velocity, using abrasion resistant materials, and smoothing slurry flowpath transitions.

As applied heretofore, however, some of the above techniques have had limited applicability in wells having relatively small bores. For example, the cross-sectional thickness of equipment cannot be increased where the equipment is already at its maximum allowable outer dimensions. Of course, internal flow passages may be reduced in order to increase the cross-sectional thickness of the equipment, but to do so would decrease the available flow area, resulting in increased slurry velocity for a given flow rate.

In addition, formation fracturing operations have begun to utilize man-made proppants which are very dense, hard and abrasive as compared to sand. Examples of these are marketed under the names Carbolite and Carboprop. The use of these and similar proppants makes it even more desirable to enhance the resistance of formation fracturing equipment to abrasion occasioned by high flow rate and high volume slurry flow therethrough.

It is accordingly an object of the present invention to provide such high flow rate formation fracturing and gravel packing equipment and associated methods of completing subterranean wells. It is also an object of the present invention to provide such equipment and methods in which a slurry flowpath is relatively unrestricted, is comparatively large for the size of the equipment, and which is relatively smooth. It is another object of the present invention to provide the equipment and methods such that their utilization is convenient and practical in application.

SUMMARY OF THE INVENTION

In carrying out the principles of the present invention, in accordance with an embodiment thereof, apparatus is provided which has an unobstructed circulating sleeve and a separate washpipe assembly, utilization of which provides reduced flow restriction while permitting the washpipe assembly to be retrieved without requiring a separate trip into the well. The washpipe assembly has an end thereof disposed adjacent the circulating sleeve, which aids in directing the slurry outward through the circulating sleeve. Associated methods are also provided.

In one aspect of the present invention, a formation fracturing and/or gravel packing tool is provided which includes an outer assembly and two separate inner assemblies. The outer assembly includes a packer, a screen, and a circulating sleeve connected between the packer and screen. One of the inner assemblies is utilized in setting the packer and in controlling circulation of the slurry through the tool. It includes an axially extendable travel joint and a latching device. The other inner assembly includes a washpipe and another latching device.

While the slurry is being flowed through the tool and outward through the circulation sleeve, the inner assemblies are separated from each other. In this manner, the interior of the circulating sleeve is relatively unobstructed to flow therethrough. The inner assemblies are later latched together, and are retrieved from the well together.

In another aspect of the present invention, the inner assemblies are uniquely interconnected to each other and to the outer assembly. Each of the inner assemblies is axially slidingly and sealingly engaged with the outer assembly. The inner assembly including the travel joint is releasably secured against axial displacement relative to the outer assembly, but when that securement is released, the inner assembly is permitted a limited range of axial displacement. The limited range is sufficient to permit the inner assembly to control flow therethrough, and to permit latching onto the inner assembly including the washpipe.

The inner assembly including the washpipe is releasably secured within the outer assembly. After it has been latched onto by the other inner assembly, it may be removed from within the outer assembly. Therefore, even though the inner assemblies are initially separated within the outer assembly, they are retrieved from the well together, but separate from the outer assembly.

In yet another aspect of the present invention, the inner assembly including the washpipe is provided with a receptacle. The receptacle is positioned adjacent the circulating sleeve. A plugging device is received in the receptacle after the packer is set in the well to thereby block a fluid passage formed through the inner assembly. Alternatively, the plugging device may be received in the receptacle without blocking the fluid passage, or the fluid passage may be blocked before the packer is set. The plugging device may be a ball which is also used in setting the packer, in which case, the ball is initially installed in the inner assembly including the travel joint.

Other objects, advantages, benefits and features of the present invention will become apparent upon careful consideration of the detailed description of an exemplary embodiment of the invention set forth hereinbelow and the accompanying drawings.

BRIEF DESCRIPTION OF THE DRAWINGS

FIGS. 1A–1M are quarter-sectional views of successive axial portions of a service tool and formation fracturing and/or gravel packing assembly embodying principles of the present invention, the service tool and assembly being shown in a configuration in which they are initially run into a subterranean well;

FIGS. 3A–3M are quarter-sectional views of successive axial portions of the service tool and assembly of FIGS. 1A–1M, the service tool and assembly being shown in a configuration in which a lower portion of the assembly has been latched.

Figure 1A:
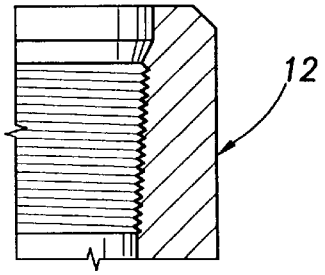
Figure 1B:
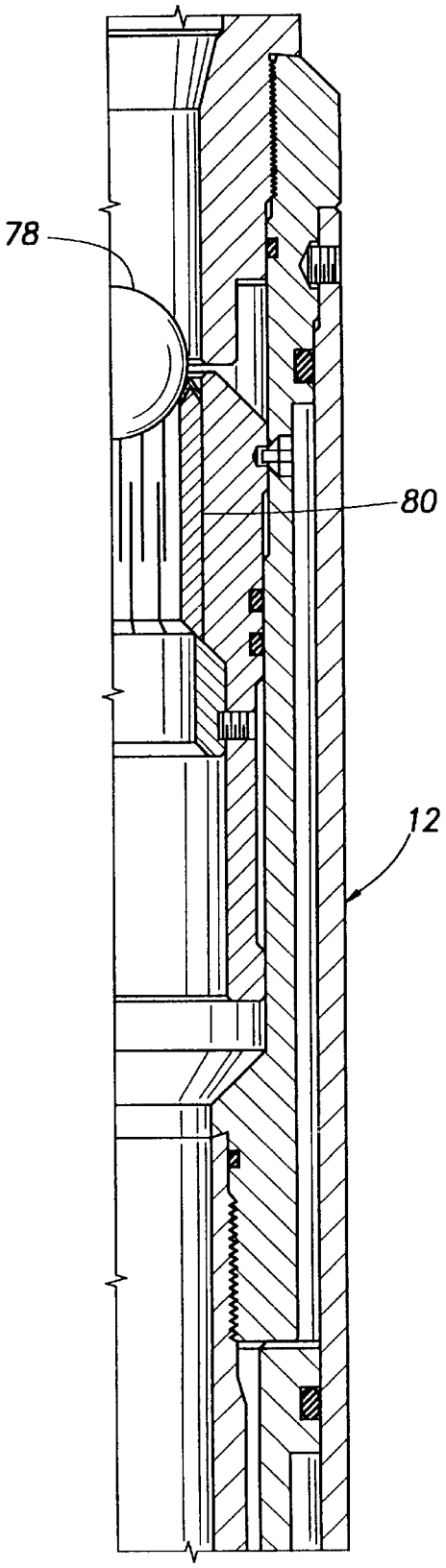
Figure 1C:
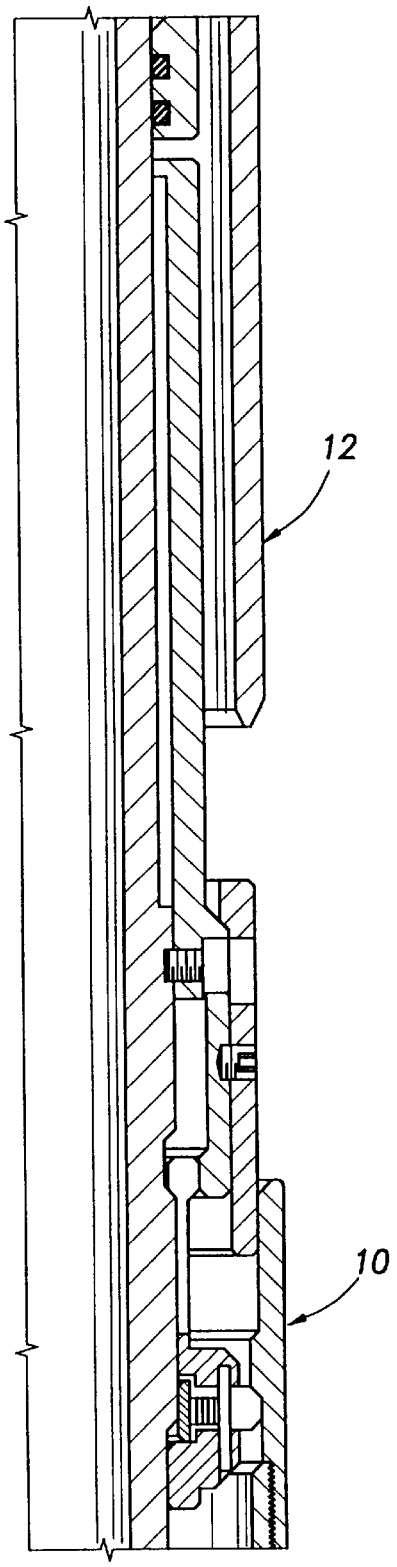
Figure 1D:
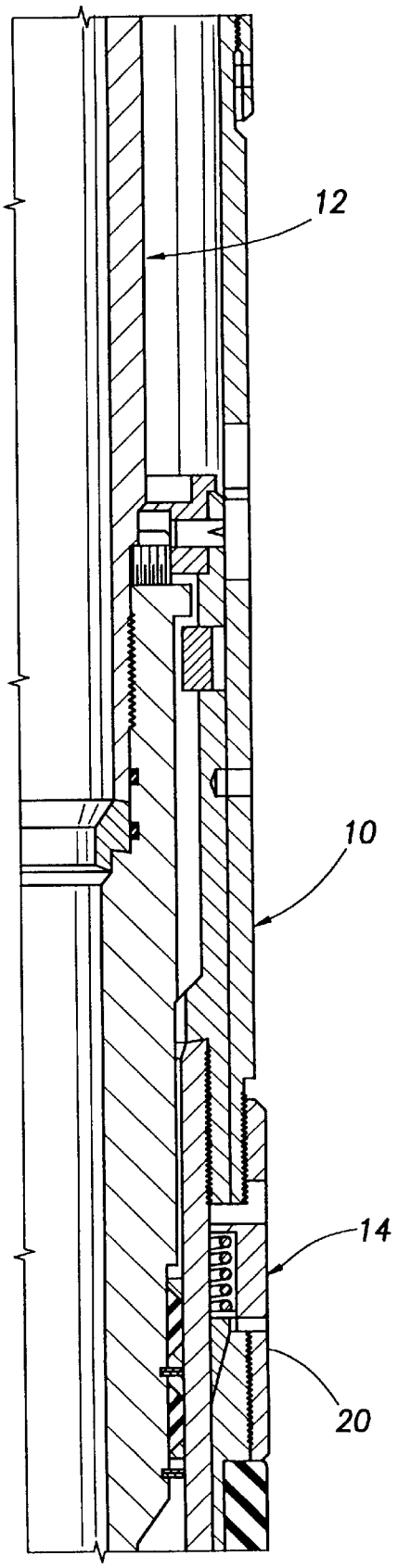
Figure 1E:
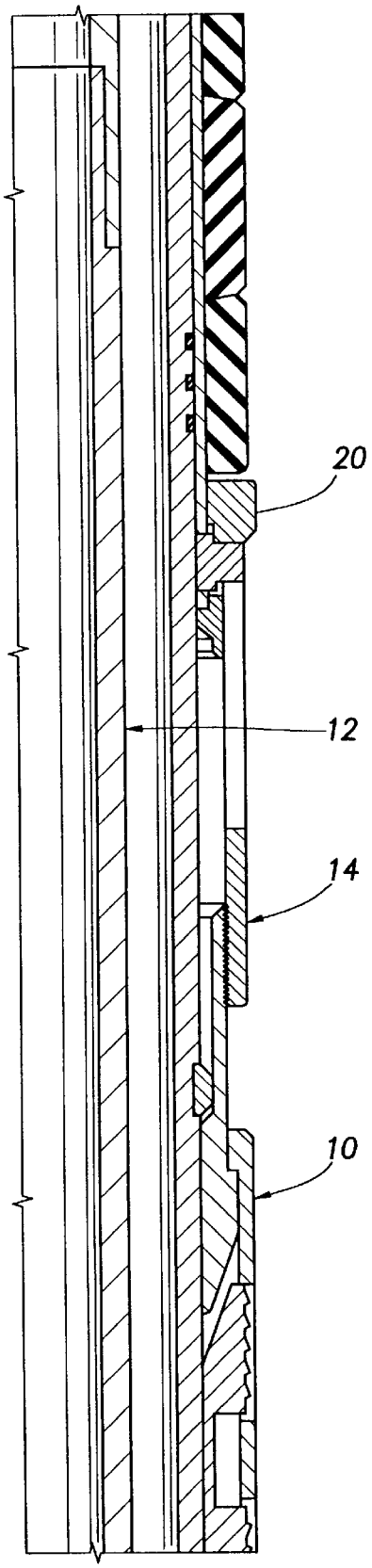
Figure 1F:
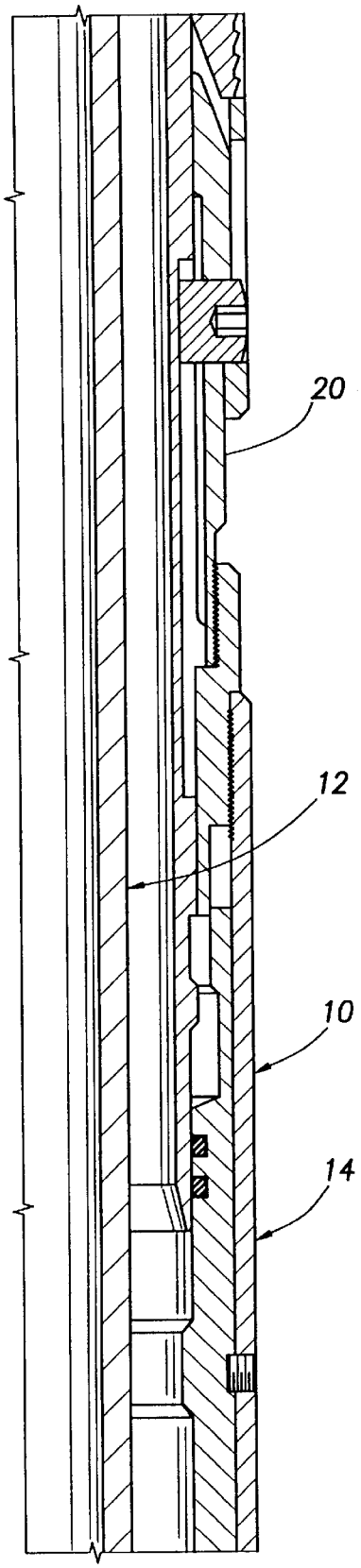

1A–1M, the service tool and assembly being shown in a configuration in which the lower portion of the assembly is being retrieved from the formation fracturing and/or gravel packing assembly.

DETAILED DESCRIPTION

Representatively illustrated in FIGS. 1A–1M is a formation fracturing and/or gravel packing assembly 10 which embodies principles of the present invention, and a service tool 12. In the following description of the assembly 10 and other apparatus and methods described herein, directional terms, such as "above", "below", "upper", "lower", etc., are used for convenience in referring to the accompanying drawings. The drawings are oriented so that an upper or top portion of a depicted assembly is to the left in a particular drawing. It is to be understood that, although the assembly 10 and other apparatus are shown in successive axial sections thereof, they are actually continuous assemblies. Additionally, it is to be understood that the various embodiments of the present invention described herein may be utilized in various orientations, such as inclined, inverted, horizontal, vertical, etc., without departing from the principles of the present invention.

The service tool 12 is a Multi-Position Tool manufactured by, and available from, Halliburton Energy Services of Houston, Tex. The Multi-Position Tool is shown in a product bulletin 7M/April 900246 published by Otis Engineering Corporation, and the disclosure contained in that bulletin is incorporated herein by this reference. The service tool 12 performs several functions related to formation fracturing and/or gravel packing operations, for example, aiding in packer setting or changing a slurry flowpath, etc., in part by being axially displaced within a wellbore in which such operations are performed. It is to be understood that functions of the service tool 12 described herein may be performed by other equipment, and that these functions may be otherwise performed, for example, by displacing the tool or equipment rotationally instead of axially, without departing from the principles of the present invention.

The assembly 10 includes an outer assembly 14, an upper inner assembly 16 and a lower inner assembly 18. The outer assembly 14 is generally tubular and substantially outwardly overlies the two inner assemblies 16, 18. The inner assemblies 16, 18 are also generally tubular, and are axially spaced apart and coaxially slidingly received within the outer assembly 14. In a manner that will be more fully described hereinbelow, the two inner assemblies 16, 18 are initially spaced apart in order to provide a desired flowpath for a slurry, and then, after the slurry delivery, the inner assemblies are latched together so that they may be retrieved from the well along with the service tool 12.

The outer assembly 14 includes a packer 20, a conventional tubular screen 22, and a generally tubular ported circulating sleeve 24 threadedly interconnected axially between the packer and screen. The representatively illustrated packer 20 is a mechanically settable VERSA-TRIEVE® packer manufactured by, and available from, Halliburton Energy Services of Houston, Tex. However, other packers and otherwise-settable packers may be used in place of the packer 20 without departing from the principles of the present invention. The screen 22 may be a wire-wrapped, sintered metal, or other type of screen.

The circulating sleeve 24 provides fluid communication generally radially through the outer assembly 14. Axially spaced apart series of circumferentially spaced apart multiple ports 25 are formed through a sidewall portion of the circulating sleeve 24 and permit substantially unrestricted flow of fluids or slurries therethrough. It is to be understood that other quantities and configurations of the ports 25 may be used without departing from the principles of the present invention.

Figure 1I:
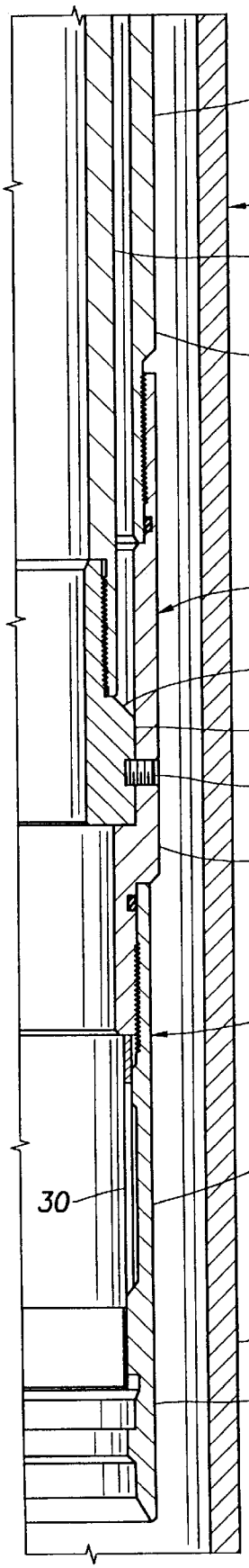

The upper inner assembly 16 is threadedly attached to the service tool 12 and is axially displaceable therewith, as will be more fully described below. The assembly 16 includes a latching device 28 and a travel joint 26 threadedly interconnected axially between the service tool 12 and the latching device. The latching device 28 is representatively illustrated as a RATCH LATCH® manufactured by, and available from, Halliburton Energy Services of Houston, Tex. It has a series of circumferentially spaced apart internally threaded axially extending fingers 30 radially outwardly surrounded by a generally tubular housing 32. When the fingers 30 are axially upwardly shifted relative to the housing 32 as shown in FIG. 1I, the fingers are permitted to radially outwardly displace, but when the fingers are axially downwardly shifted relative to the housing (see FIG. 4J), the housing prevents such outward displacement of the fingers. It is to be clearly understood that other latching devices, such as conventional fishing tools, shifting tools, etc., may be used for the latching device 28 without departing from the principles of the present invention.

The travel joint 26 includes telescopingly disposed substantially coaxially overlapping inner and outer generally tubular members 34, 36, respectively. As shown in FIGS. 1G–1I, the travel joint 26 is in its axially compressed configuration, and is secured in this configuration by one or more shear screws 38 threadedly installed through a coupling 40, which is threadedly interconnected axially between the outer member 36 and the latching device 28. The shear screw 38 extends into a circumferential groove formed externally on an end cap 43, which is threadedly connected to the inner member 34.

The inner member 34 is threadedly attached at its upper end to the service tool 12. Thus, if the service tool 12 is displaced axially upward, the inner and outer members 34, 36, as well as the remainder of the upper inner assembly 16, will be upwardly displaced therewith. However, an inclined shoulder 42, which is externally formed on a generally C-shaped circumferentially expanded ring 44 and carried on a generally tubular member 46 threadedly interconnected to the outer member 36, will eventually contact an inclined shoulder 48, which is internally formed on a circumferential stop ring 50 secured internally between the packer 20 and the circulating sleeve 24, thereby preventing further axially upward displacement of the outer member 36 relative to the outer assembly 14. In a manner that will be more fully described hereinbelow, the outer member 36 may be axially upwardly displaced relative to the outer assembly 14, even though the shoulders 42, 48 have contacted, by applying a sufficient upward force to the outer member 36 to cause one or more shear screws 52 to shear and permit the ring 44 and a retaining sleeve 56 to axially downwardly displace relative to the member 46 and radially inwardly retract into a circumferential groove 54 externally formed on the member 46. The shear screw 52 is threadedly installed through the sleeve 56 and into another circumferential groove formed externally on the member 46.

A generally tubular slip housing 58 is threadedly interconnected axially between the member 46 and the outer member 36. The slip housing 58 retains a series of circumferentially spaced apart internally toothed slip segments 60 (only one of which is visible in FIG. 1H) and a biasing member. The biasing member, representatively a spring 62, biases the slip segments 60 into axial contact with an inclined face 64 internally formed on the slip housing 58. The slip segments 60 are, thus, maintained in radial gripping contact with the inner member 34. In this manner, the slip segments 60 permit axially upward displacement of the inner member 34 relative to the outer member 36, but do not permit axially downward displacement of the inner member relative to the outer member. However, such relative displacement between the inner and outer members 34, 36 is initially prevented by the shear screw 38 as described above.

It will be readily appreciated by one of ordinary skill in the art that if the service tool 12 is axially upwardly displaced relative to the outer assembly 14, and the shoulders 42, 48 are brought into contact with each other, and a sufficient upwardly directed force is applied to the service tool to shear the shear screw 38, the inner member 34 will be permitted to further axially upwardly displace with the service tool, the travel joint 26 will be, thus, axially extended and the slip segments 60 will prevent subsequent axial compression of the travel joint. Such axial extension of the travel joint 26 will continue until a shoulder 65 externally formed on the end cap 43 contacts a shoulder 66 internally formed on the slip housing 58. Additionally, further axially upwardly directed force may be applied to the service tool 12 to shear the shear screw 52 and thereby permit upward displacement of the entire upper inner assembly 16 from within the outer assembly 14. For this purpose (i.e., to permit axial extension of the travel joint 26 before shearing the shear screw 52), the shear strength of the shear screw 52 (or multiple shear screws 52) is preferably greater than the shear strength of the shear screw 38 (or multiple shear screws 38).

The lower inner assembly 18 includes a latching device 68, a generally tubular washpipe 72 and a generally tubular receptacle 70 threadedly interconnected axially between the latching device and the washpipe. The latching device 68 is configured for cooperative engagement with the latching device 28 of the upper inner assembly 16. Thus, as representatively illustrated, the latching device 68 is externally threaded for complementary engagement with the internally threaded fingers 30 of the latching device 28. However, it is to be clearly understood that the latching device 68 may be otherwise configured for latching engagement of the upper inner assembly 16 to the lower inner assembly 18 without departing from the principles of the present invention. For example, if the latching device 28 is configured similar to a conventional shifting tool, the latching device 68 may correspondingly have a conventional shifting profile formed internally thereon, etc.

Figure 1J:
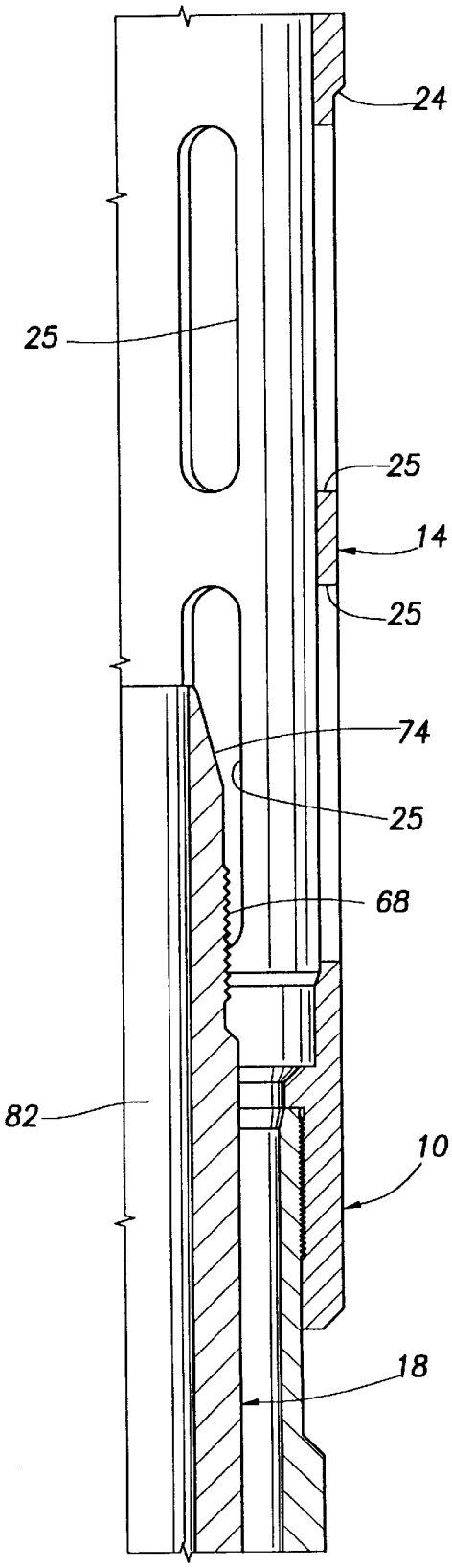
Figure 1K:
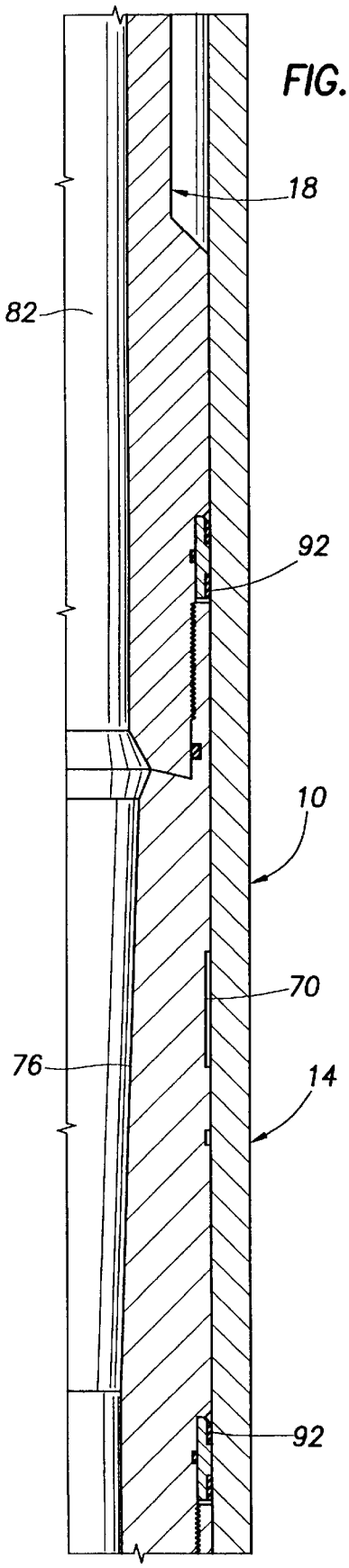
Figure 1L:
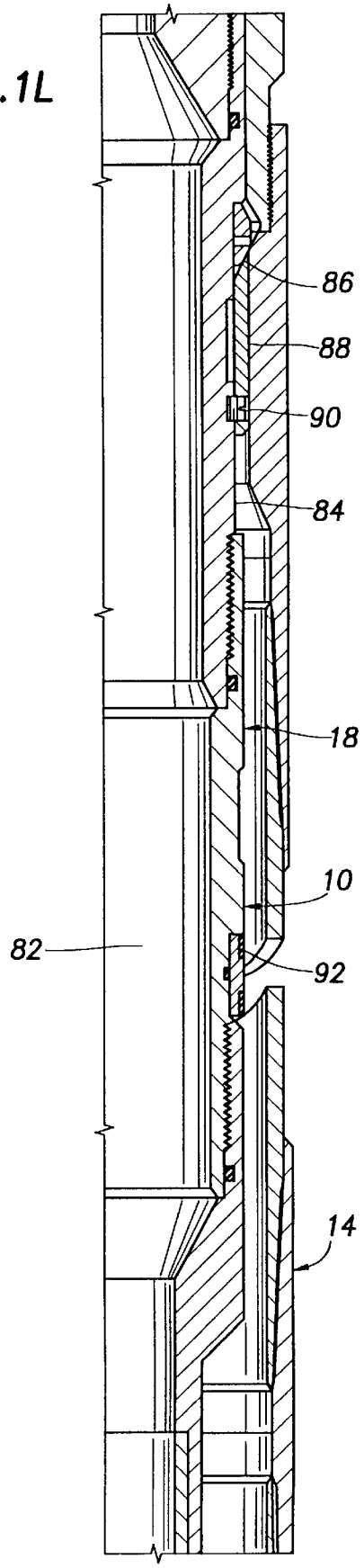
Figure 1M:
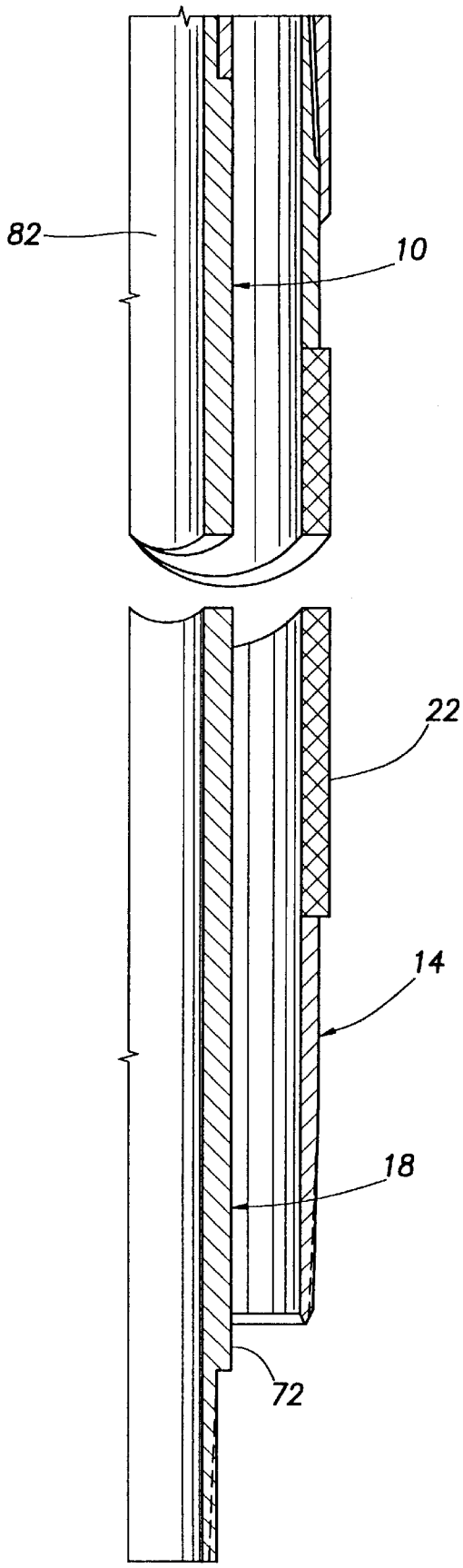

The latching device 68 is positioned within the circulating sleeve 24 as shown in FIG. 1J. An upper inclined face 74 formed externally on the latching device 68 is somewhat downwardly disposed relative to the ports 25. In a manner that will be more fully described hereinbelow, the latching device 68 with its associated inclined face 74 helps to direct flow of a slurry outward through the ports 25, without effectively obstructing the ports.

The receptacle 70 includes an axially extending tapered internal surface 76. In a manner that will be more fully described hereinbelow, the surface 76 is configured for sealing engagement with a plugging device, such as a ball 78 (see FIG. 1B). The ball 78 is initially utilized in the service tool 12 for hydraulically setting the packer 20 and thereafter is expelled downwardly through an expandable ball seat 80, at which time it may drop further downward and be received in the receptacle 70. Other plugging devices, for example, a dart having seals carried thereon, may be used for sealing engagement with the receptacle 70 without departing from the principles of the present invention. Alternatively, an axially extending flow passage 82 formed through the lower inner assembly 18 may be initially plugged when the assembly 10 and service tool 12 are run into the well, in which case a plugging device may already be sealingly received in the receptacle 70 when the packer 20 is set. As another alternative, the flow passage 82 may not extend axially through the latching device 68 (i.e., the latching device or other portion of the lower inner assembly 18 may block the flow passage), in which case the receptacle 70 may not be included in the lower inner assembly. However, in this last alternative, the latching device 68 may include an upwardly facing recess in order to receive the ball 78 therein after it is expelled from the ball seat 80.

The washpipe 72 extends axially through the screen 22. Additional screens and/or blank sections may be attached to the screen 22 at its threaded lower end, and corresponding additional washpipes may be attached to the washpipe 72 at its threaded lower end. Additionally, a sump packer (not shown) and/or other equipment, such as a bull plug, etc., may be attached to the screen 22 in a conventional manner.

A generally tubular member 84 is threadedly interconnected axially between the receptacle 70 and the washpipe 72. The member 84 carries a generally C-shaped circumferentially expanded ring 86, a generally tubular sleeve 88 and one or more shear screws 90 externally thereon. The ring 86, sleeve 88 and shear screw 90 function similarly to the ring 44, sleeve 56 and shear screw 52 described above, to releasably secure the lower inner assembly 18 within the outer assembly 14. Thus, in a manner that will be more fully described hereinbelow, after the latching devices 28, 68 have been engaged and an upwardly directed force is applied to the upper inner assembly 16 to axially upwardly displace the upper inner assembly, the lower inner assembly 18 may be upwardly displaced therewith by applying a sufficient force to shear the shear screw 90.

Note that the lower inner assembly 18 is sealingly engaged with the interior of the outer assembly 14 by means of a series of axially spaced apart circumferential seals 92 carried externally thereon.

Figure 2C:
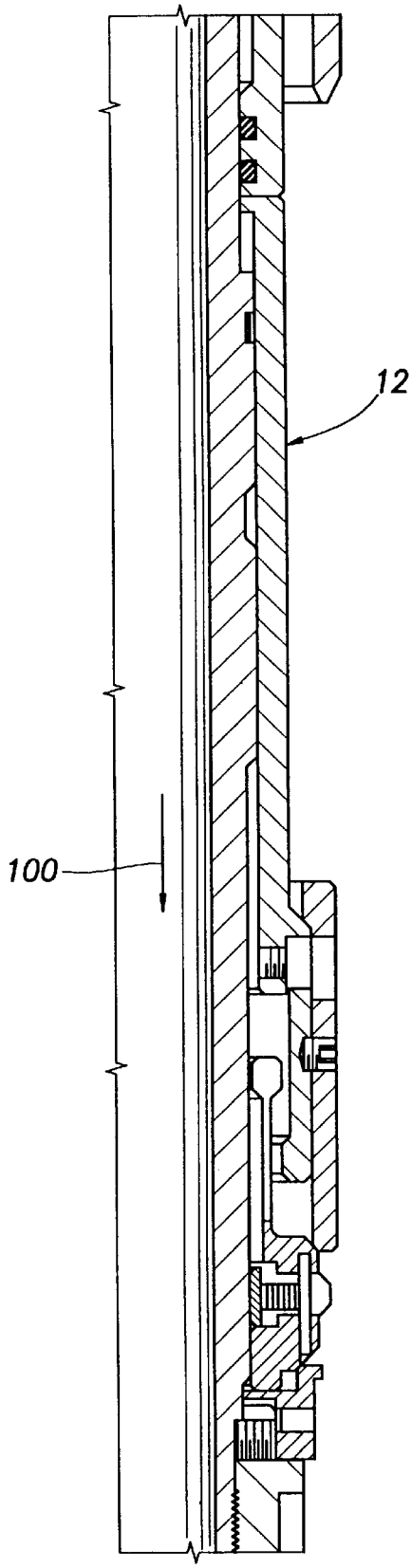
FIGS. 2A–2N are quarter-sectional views of successive axial portions of the service tool and assembly of FIGS. 1A–1M, the service tool and assembly being shown in a configuration in which a packer of the assembly is set within the well and a travel joint of the service tool is extended.
Figure 2D:
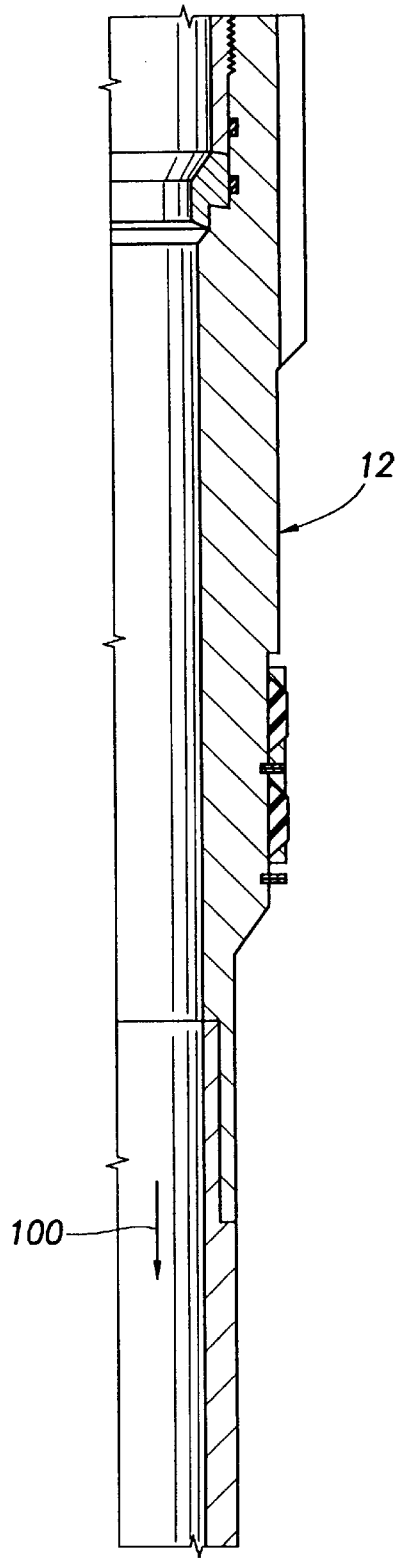
Figure 2E:
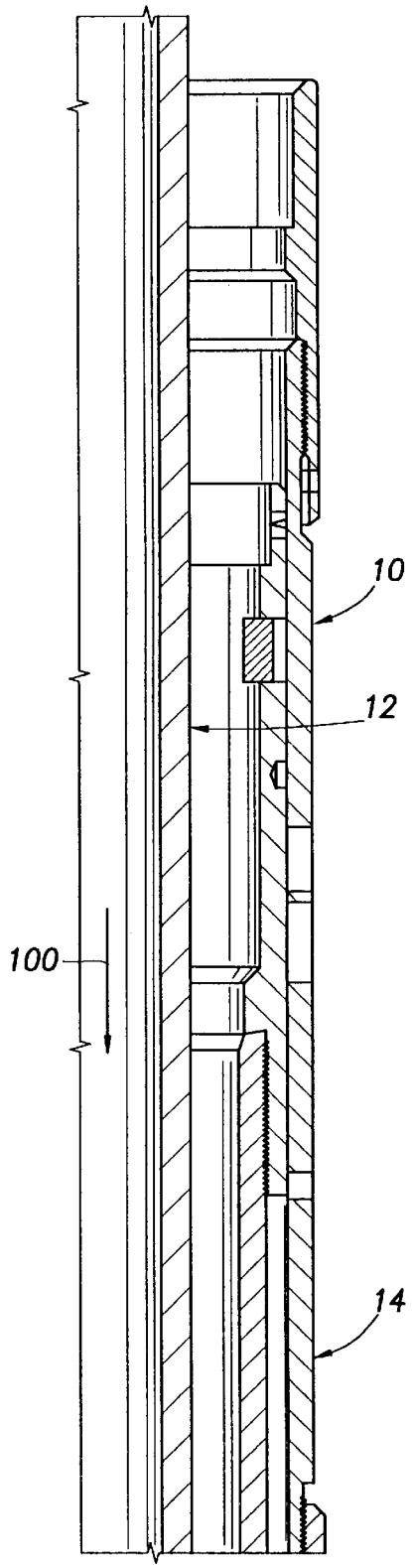
Figure 2F:
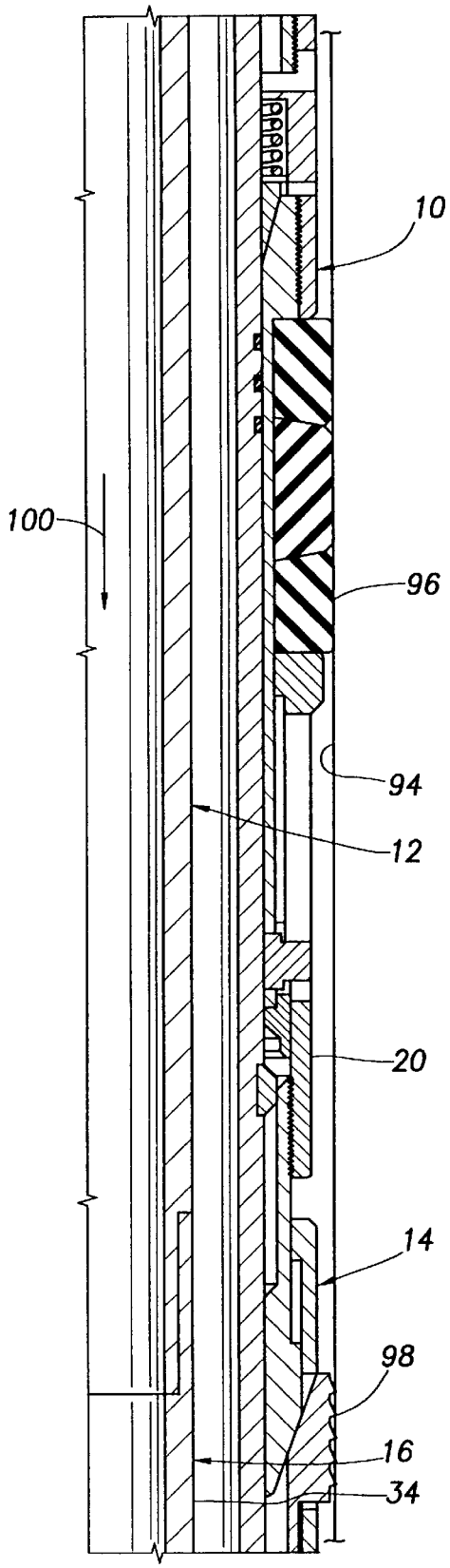
Figure 2G:
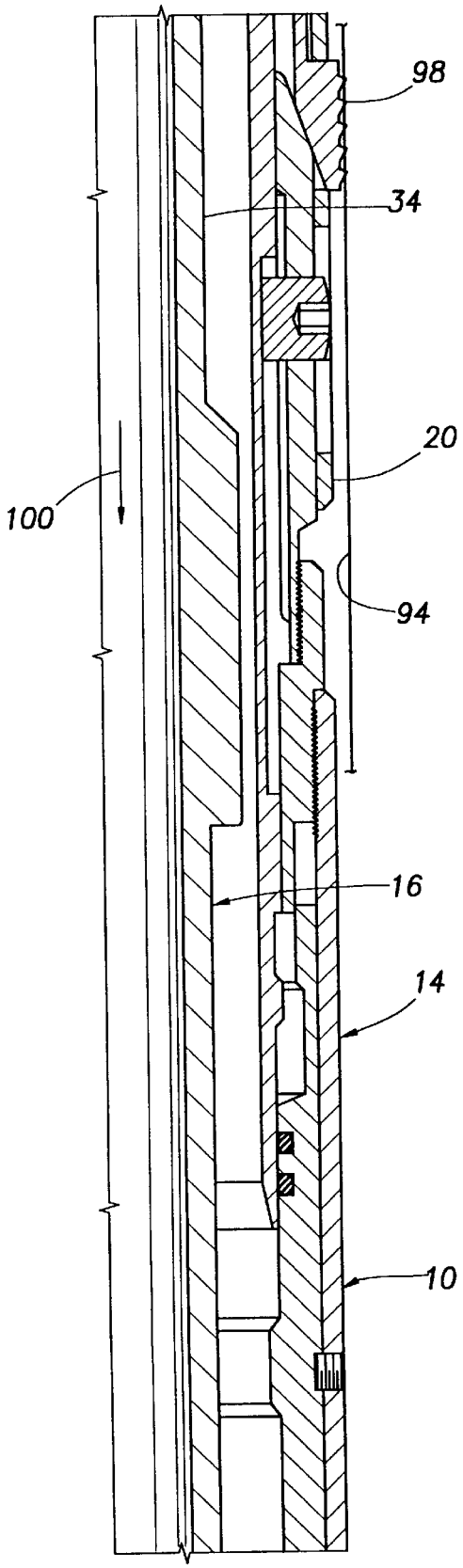
Figure 2H:
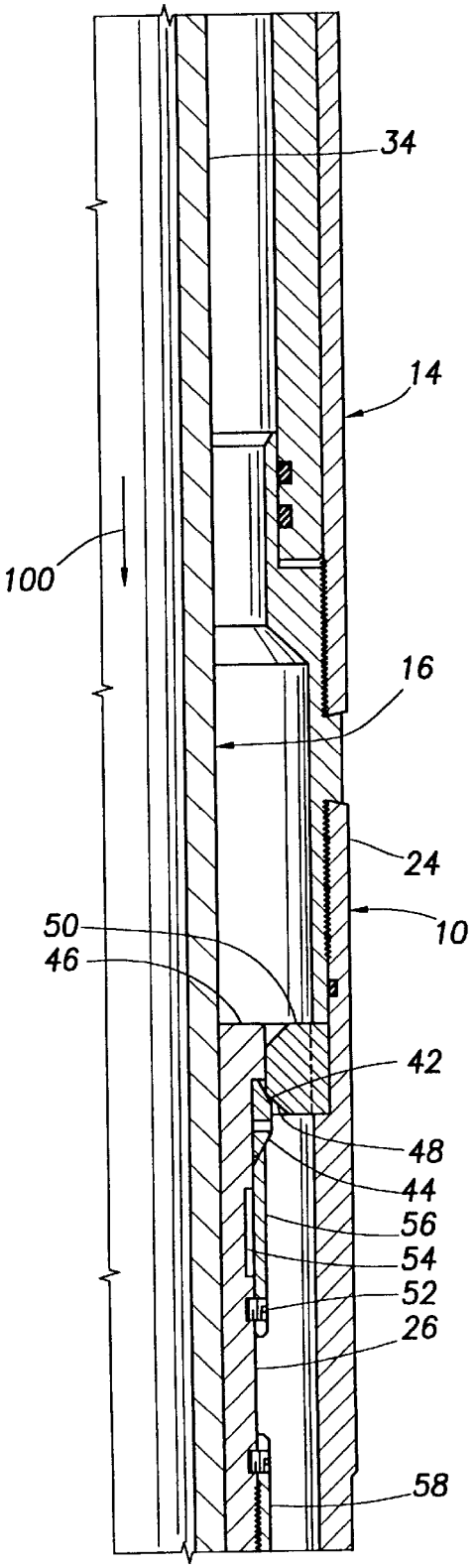
Figure 2M:
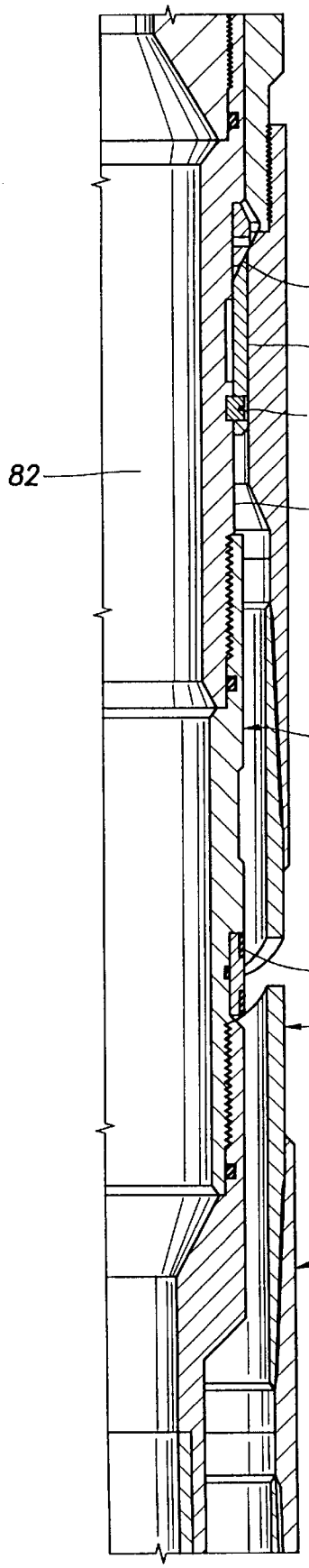
Figure 2N:
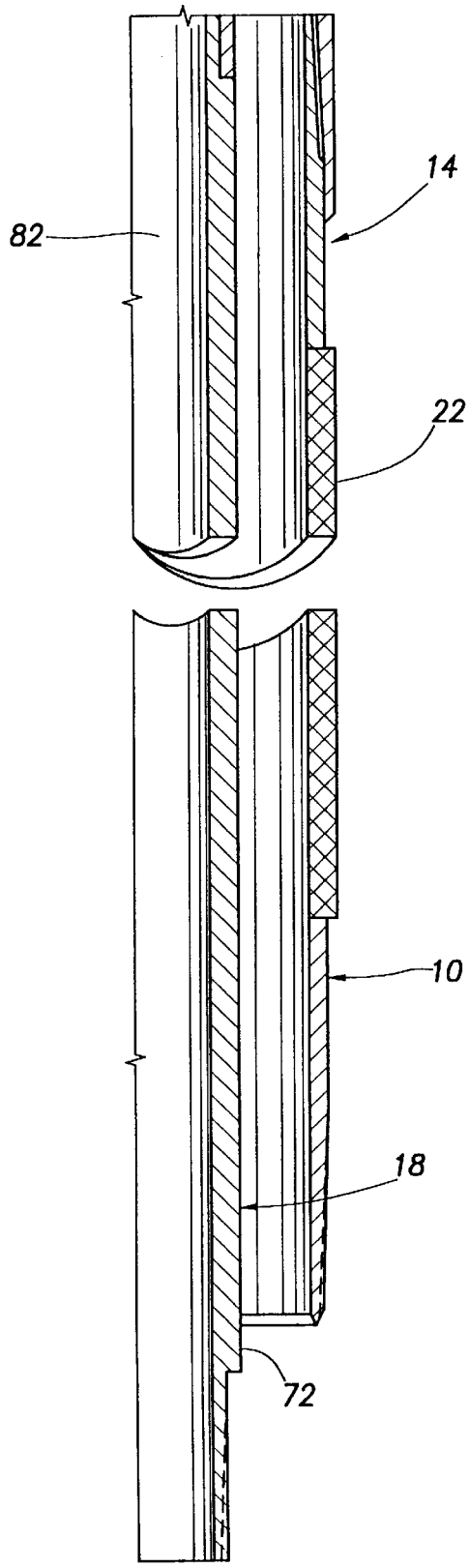

Referring additionally now to FIGS. 2A–2N, the formation fracturing and/or gravel packing assembly 10 is representatively illustrated in a configuration in which the packer 20 has been set within a protective casing 94 lining the well, and the travel joint 26 has been axially extended. The packer 20 is set by applying fluid pressure to the service tool 12 in a conventional manner. When the packer 20 is set in the casing 94, circumferential seal elements 96 carried externally on the packer radially outwardly extend and sealingly engage the casing, and a set of circumferentially spaced apart slips 98 (only one of which is visible in FIGS. 2F–2G) radially outwardly displace to grippingly engage the casing. Thus, as shown in FIGS. 2A–2N, the assembly 10 is sealingly and grippingly engaged with the casing 94, and the outer assembly 14 is prevented from displacing relative to the casing.

The travel joint 26 has been axially extended by applying an upwardly directed force to the service tool 12 to thereby shear the shear screw 38 and permit the inner member 34 to axially upwardly displace relative to the outer member 36. At this point the shoulders 65, 66 are contacting, preventing further upward displacement of the inner member 34. However, note that sufficient upward force has not been applied to shear the shear screw 52 and, thus, the upper inner assembly 16 remains releasably secured within the outer assembly 14, although it may be axially reciprocated therein.

The slip segments 60 are grippingly engaging the inner member 34. This gripping engagement prevents axial compression of the travel joint 26. Thus, at this point, the travel joint 26 is maintained in its axially extended configuration by the slip segments 60.

The ball 78 has been expended through the ball seat 80 after setting of the packer 20. The ball 78 is now received within the receptacle 70 and sealingly engages the tapered surface 76. Therefore, if fluid, or a mixture of fluid and particulate matter, such as a slurry (indicated by arrows 100), is flowed from the earth's surface downward through the service tool 12, and through the upper inner assembly 16, the ball 78 or other plugging device will prevent the slurry from flowing through the flow passage 82 and into the interior of the screen 22. Instead, the slurry 100 is directed to flow outward through the ports 25 of the circulating sleeve 24.

Note that the latching device 68 and the remainder of the lower inner assembly 18 do not obstruct the ports 25. In addition, the inclined face 74 acts to deflect the slurry 100 toward the ports 25, thus smoothing the slurry's transition from axially directed flow to generally radially directed flow. It is a distinct benefit of the assembly 10 embodying principles of the present invention that flow of the slurry 100 is unimpeded by the upper and lower inner assemblies 16, 18. A feature of the present invention that enhances this benefit is that the upper and lower inner assemblies 16, 18 are axially spaced apart while the slurry 100 is being flowed through the ports 25.

Referring additionally now to FIGS. 3A–3M, the formation fracturing and/or gravel packing assembly 10 is representatively illustrated in a configuration in which the upper inner assembly 16 and service tool 12 have been first upwardly, and then downwardly, displaced relative to the outer assembly 14. The assembly 10 would preferably be in this configuration after delivery of the slurry 100 has been completed. In order to place the assembly 10 in this configuration, the service tool 12 may be raised and then lowered relative to the outer assembly 14, which remains sealingly and grippingly engaged with the casing 94.

Initially, the upper inner assembly 16 is raised relative to the outer assembly 14 to thereby bring the shoulders 42, 48 into contact with each other. Thereafter, a sufficient axially upwardly directed force has been applied to the service tool 12 to shear the shear screw 52, thereby permitting radial retraction of the ring 44 and releasing the upper inner assembly 16 and the service tool 12 for further axially upward displacement relative to the outer assembly 14. The upper inner assembly 16 is then lowered relative to the outer assembly 14 to its position as shown in FIGS. 3A–3M.

Figure 3A:
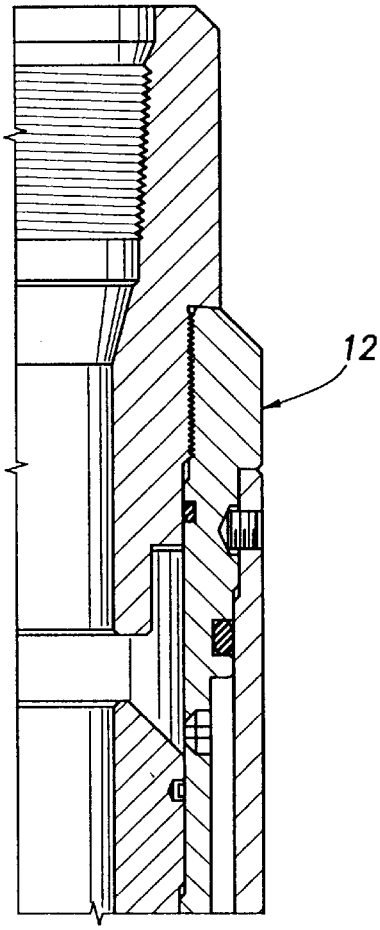
Figure 3B:
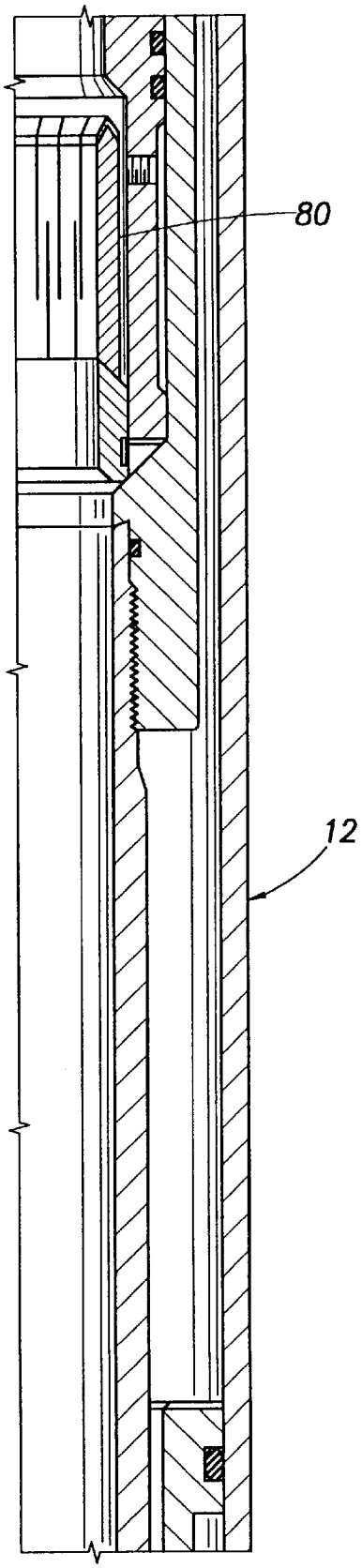
Figure 3C:
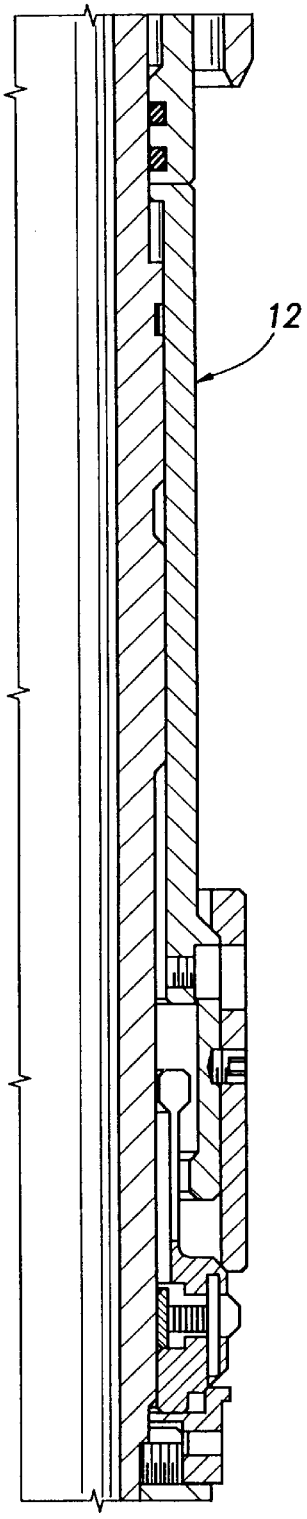
Figure 3D:
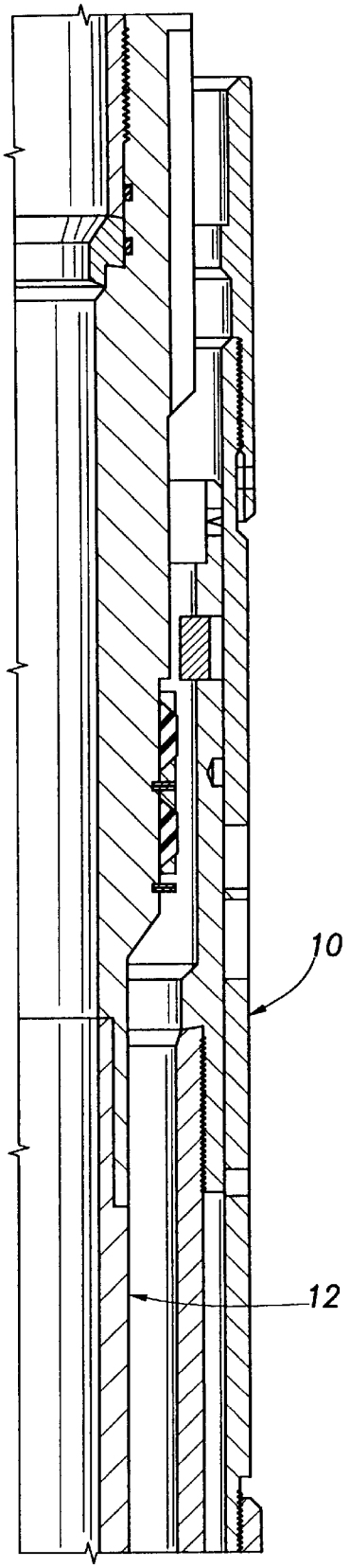
Figure 3E:
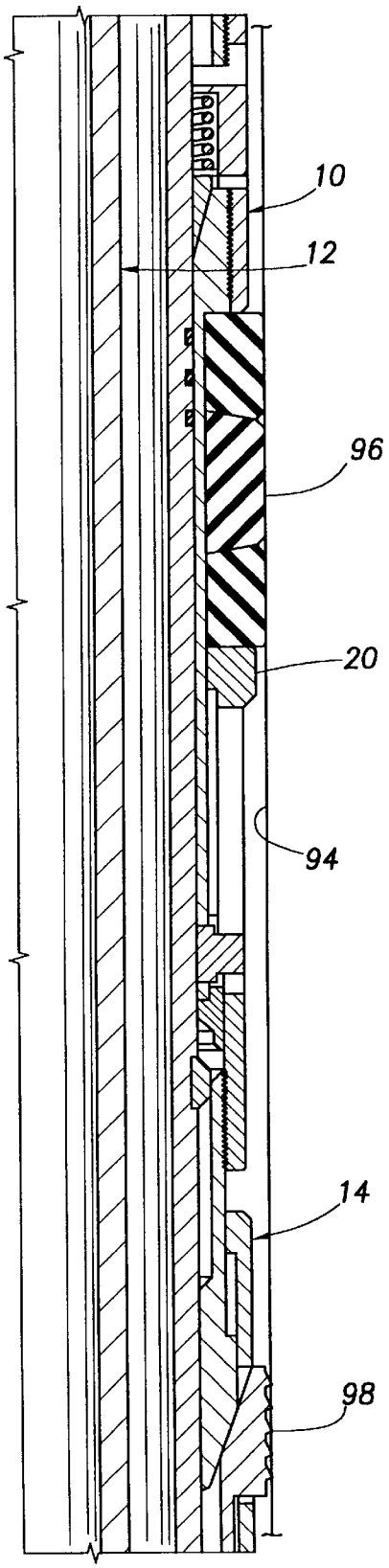
Figure 3F:
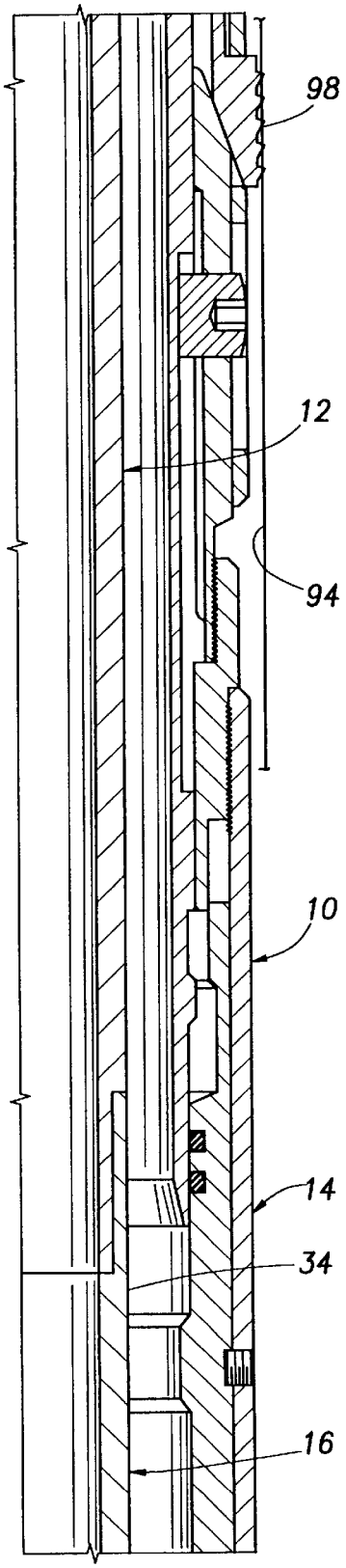
Figure 3I:
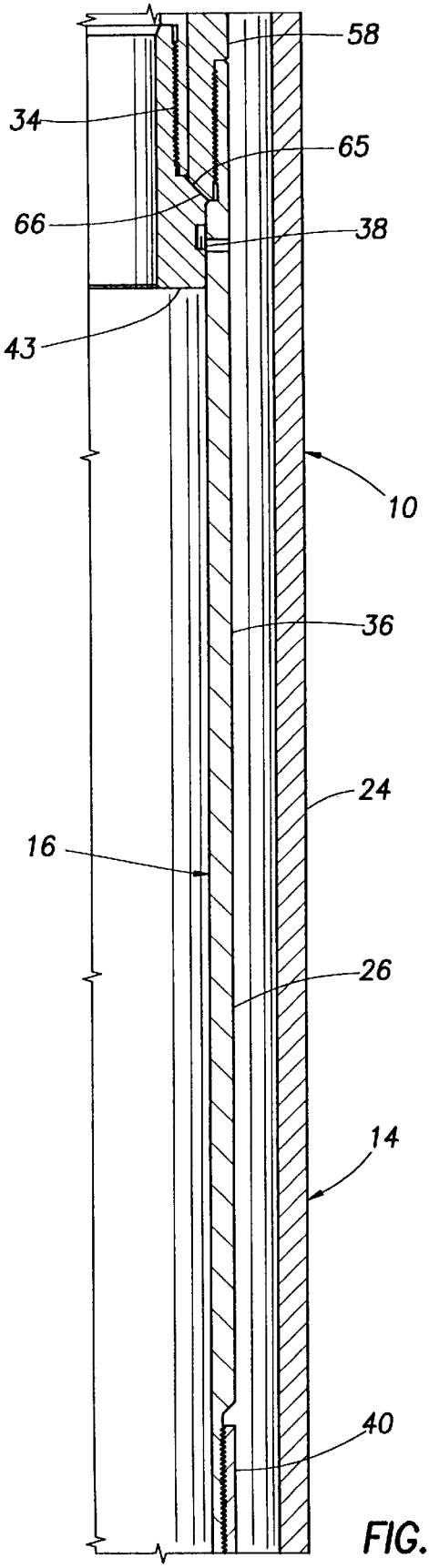
Figure 3J:
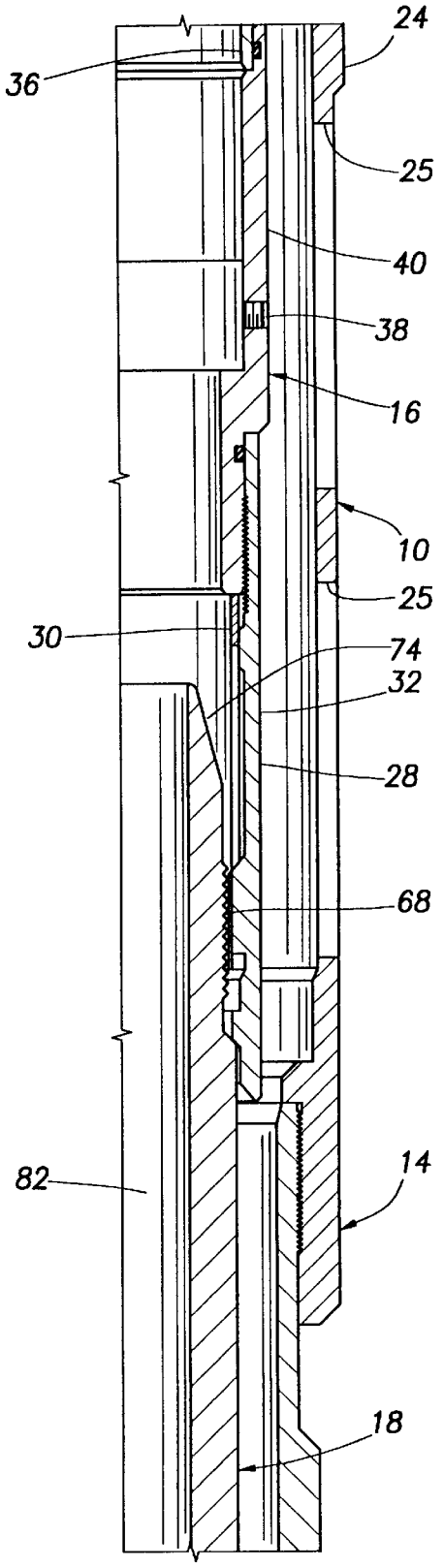
Figure 3K:
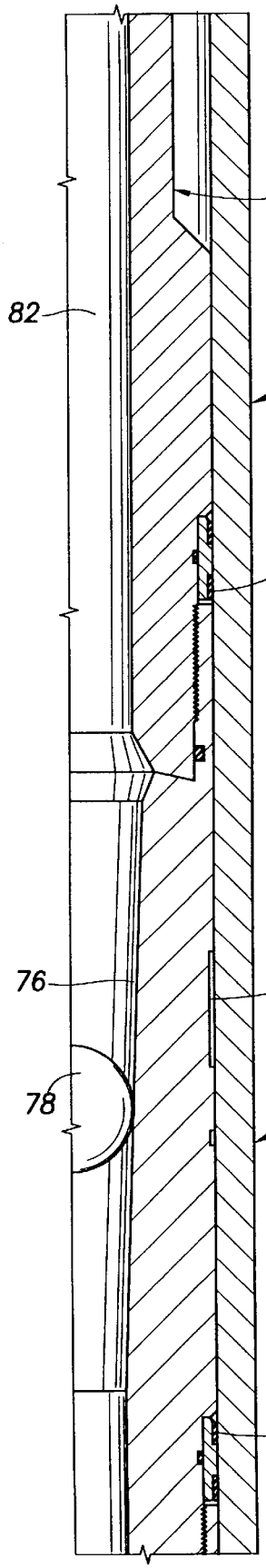
Figure 3L:
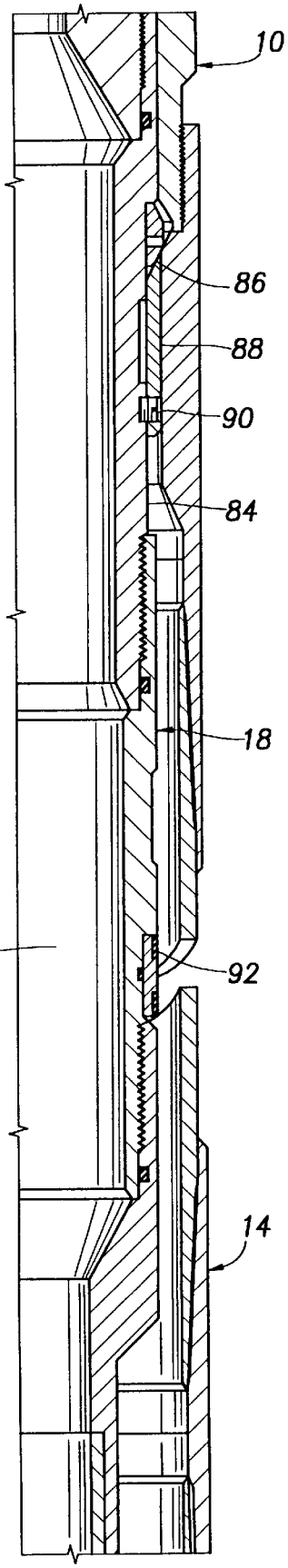
Figure 3M:
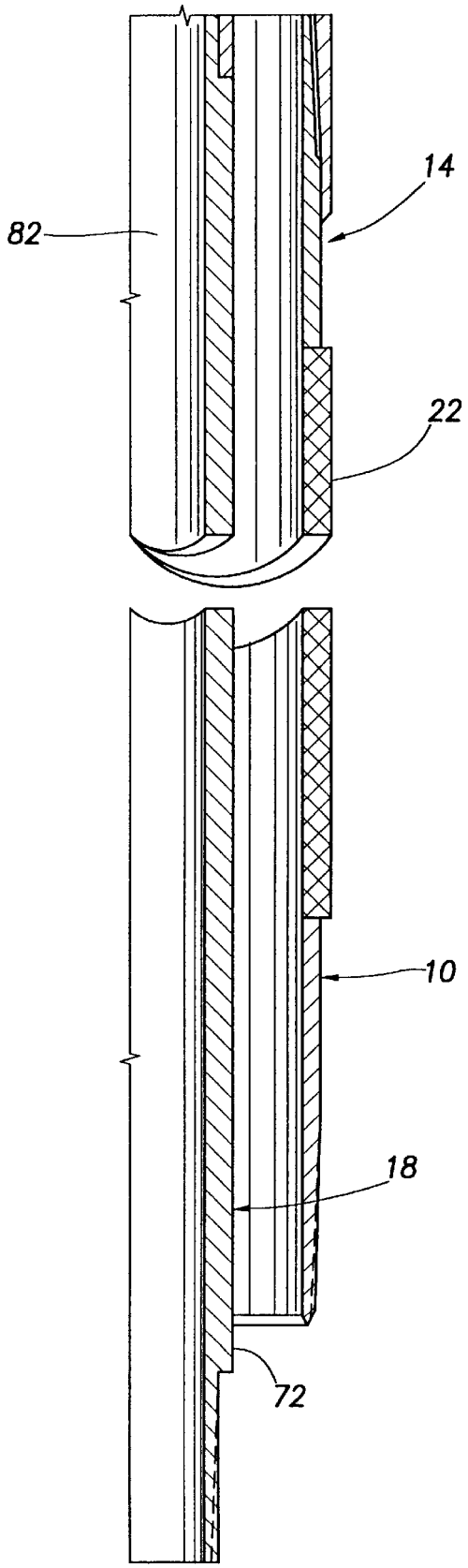

As best viewed in FIG. 3J, such axially downward displacement of the upper inner assembly 16 relative to the outer assembly 14 has brought the latching devices 28, 68 into latching engagement with each other. Thus, in the exemplary embodiment shown in FIG. 3J, the fingers 30 have radially outwardly extended as the latching device 68 has been received within the housing 32, the internal threads on the fingers complementarily engaging the external threads on the latching device 68.

The travel joint 26 is not axially compressed by the axially downward displacement of the service tool 12, even though the latching devices 28, 68 have shouldered up and a compressive force may be experienced in the upper inner assembly 16. The gripping engagement of the slip segments 60 with the inner member 34 prevents such axial compression.

At this point, the upper and lower inner assemblies 16, 18 are axially engaged, i.e., they are attached to one another and may be axially displaced together. However, the ring 86 prevents removal of the inner assemblies 16, 18 and service tool 12 from within the outer assembly 14.

Figure 4A:
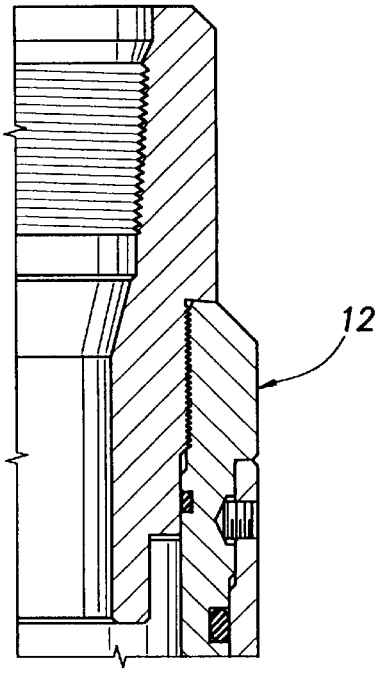
FIGS. 4A–4O are quarter-sectional views of successive axial portions of the service tool and assembly of FIGS.
Figure 4B:
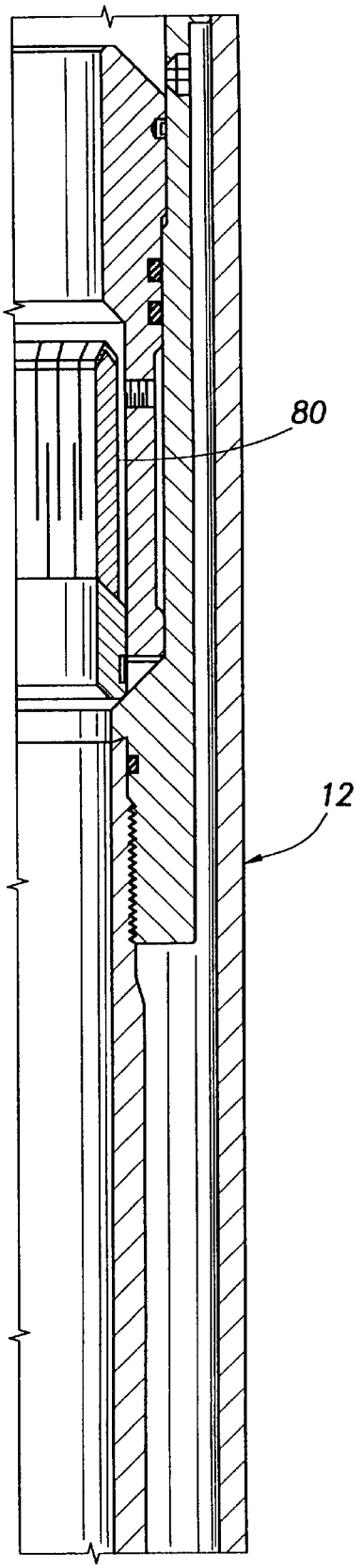
Figure 4C:
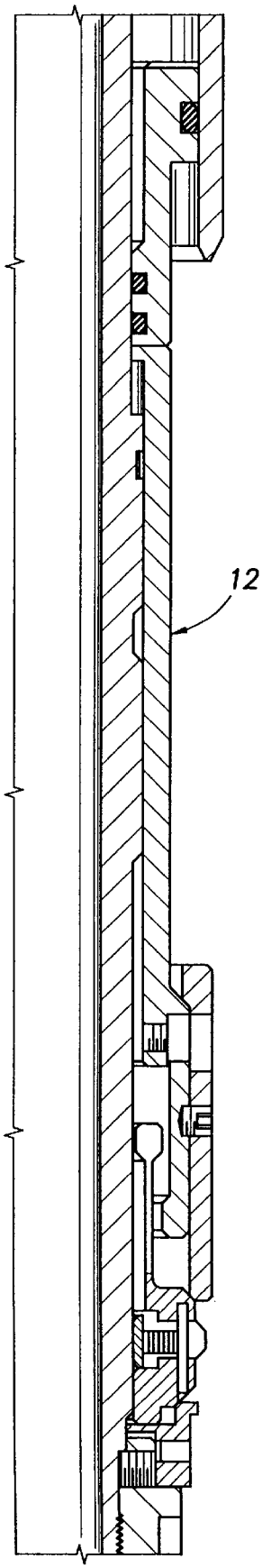
Figure 4D:
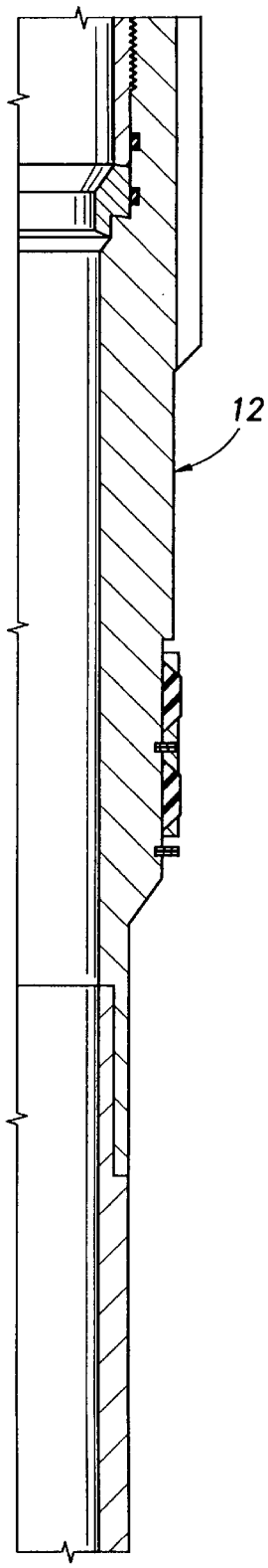
Figure 4E:
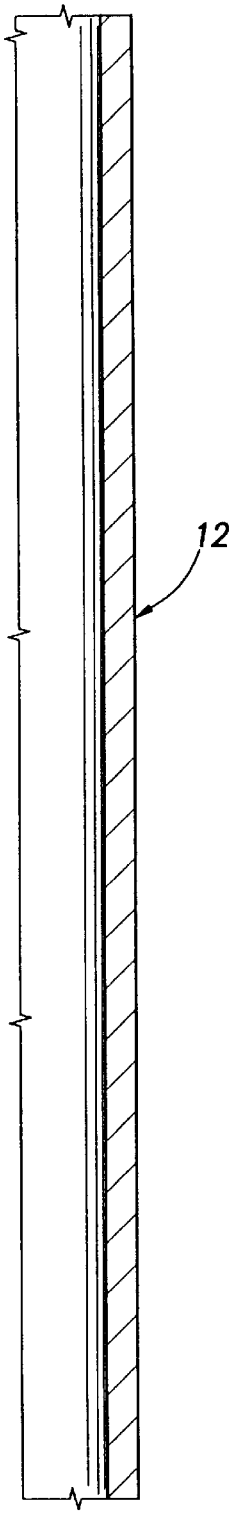
Figure 4F:
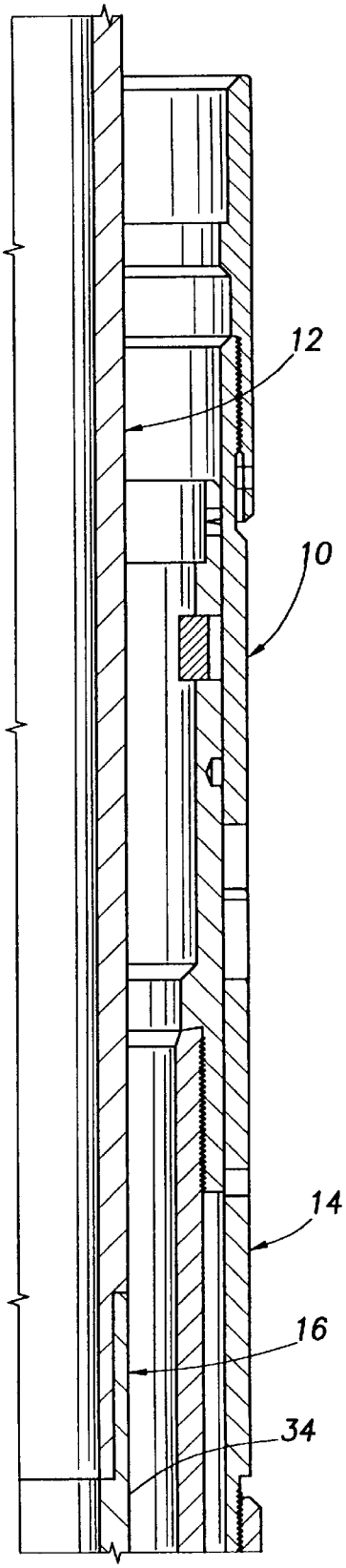
Figure 4G:
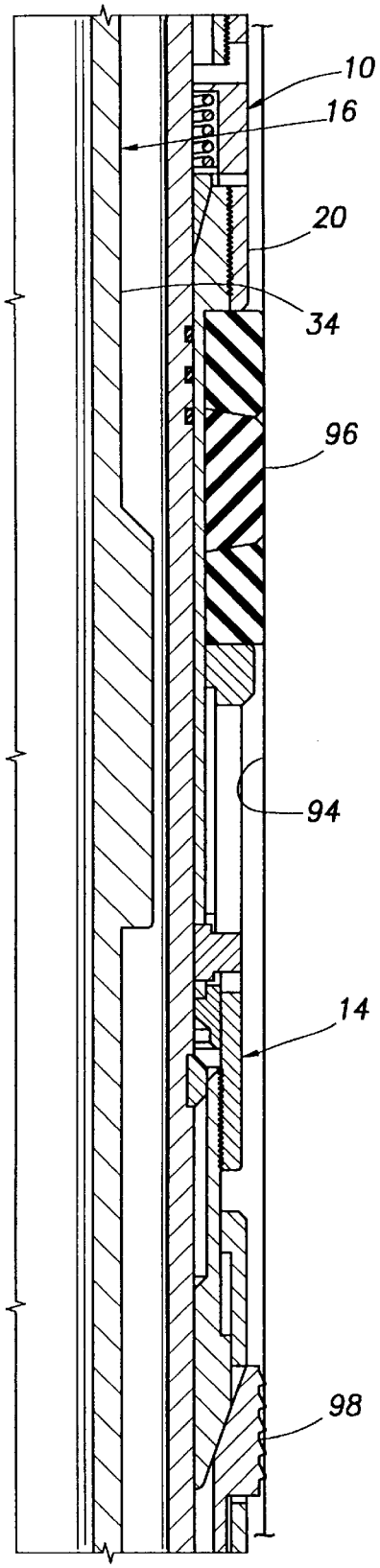
Figure 4H:
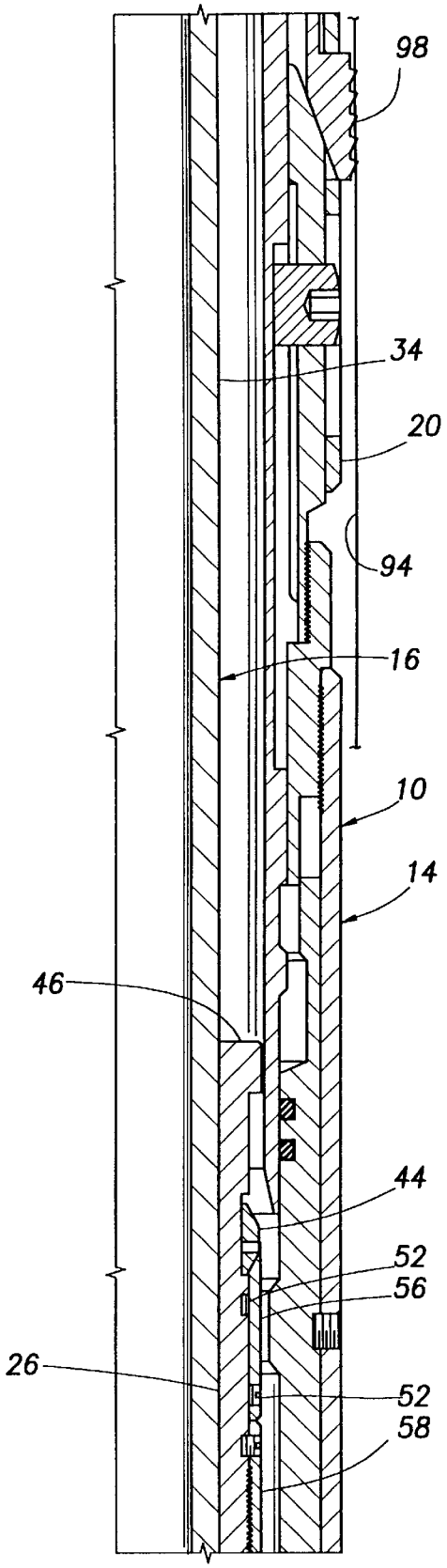
Figure 4K:
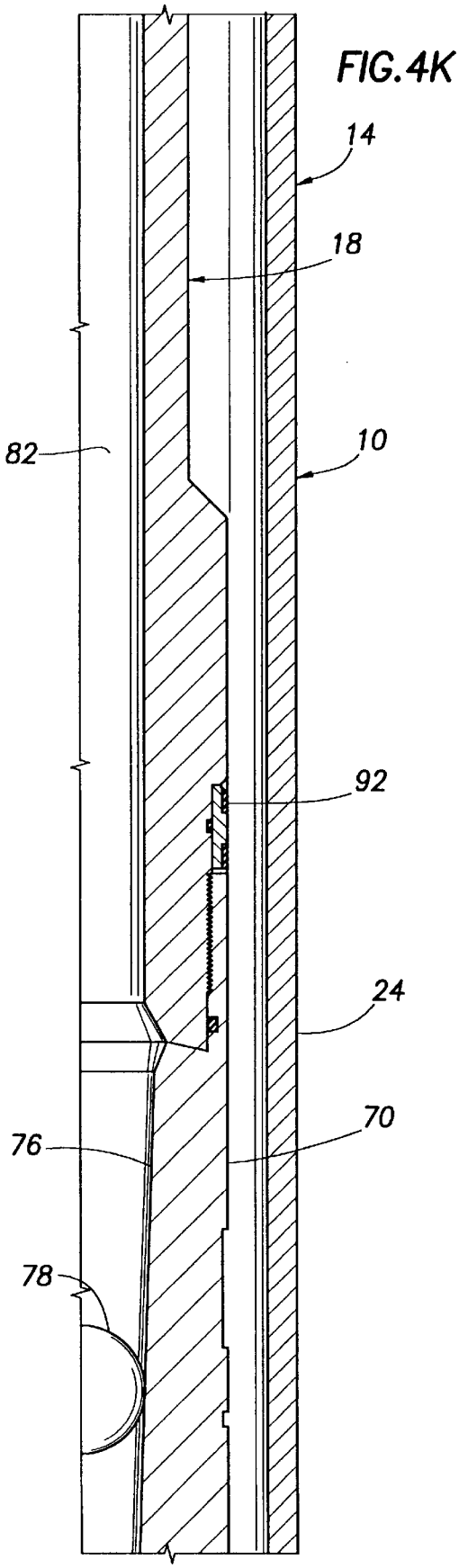
Figure 4L:
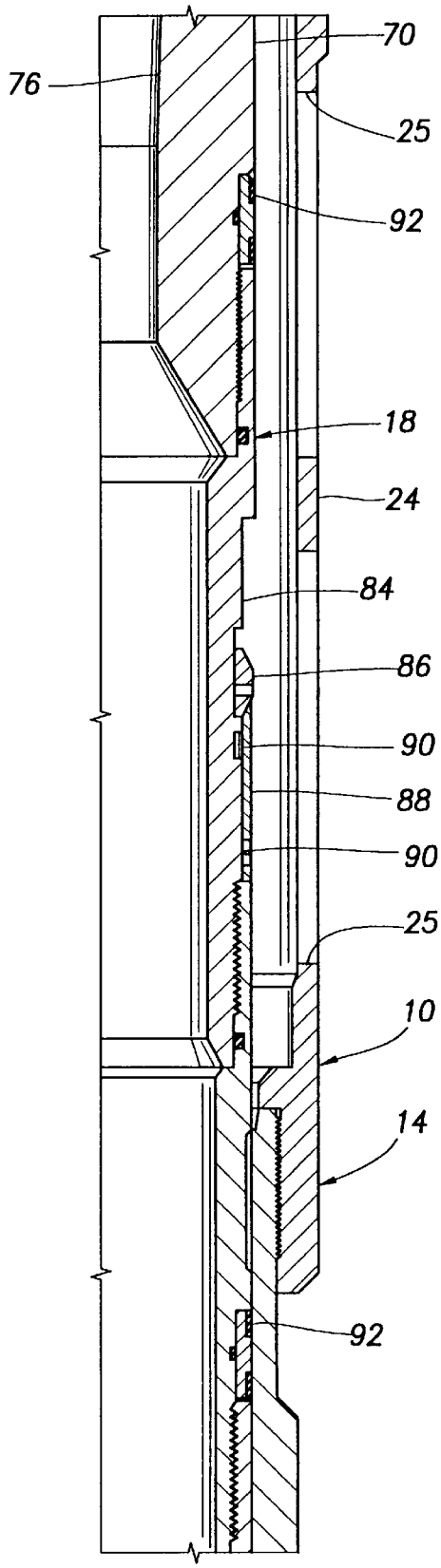
Figure 4M:
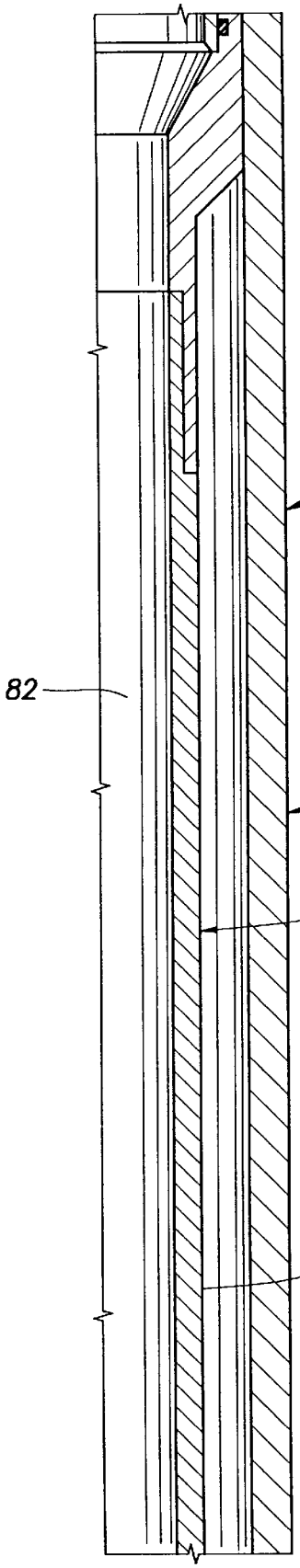
Figure 4N:
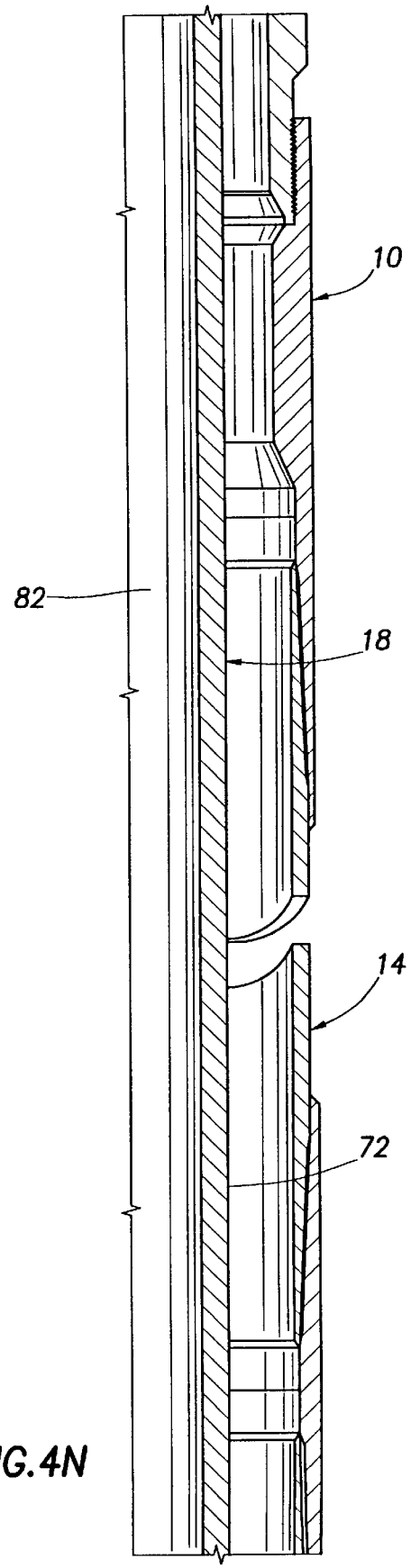
Figure 40:
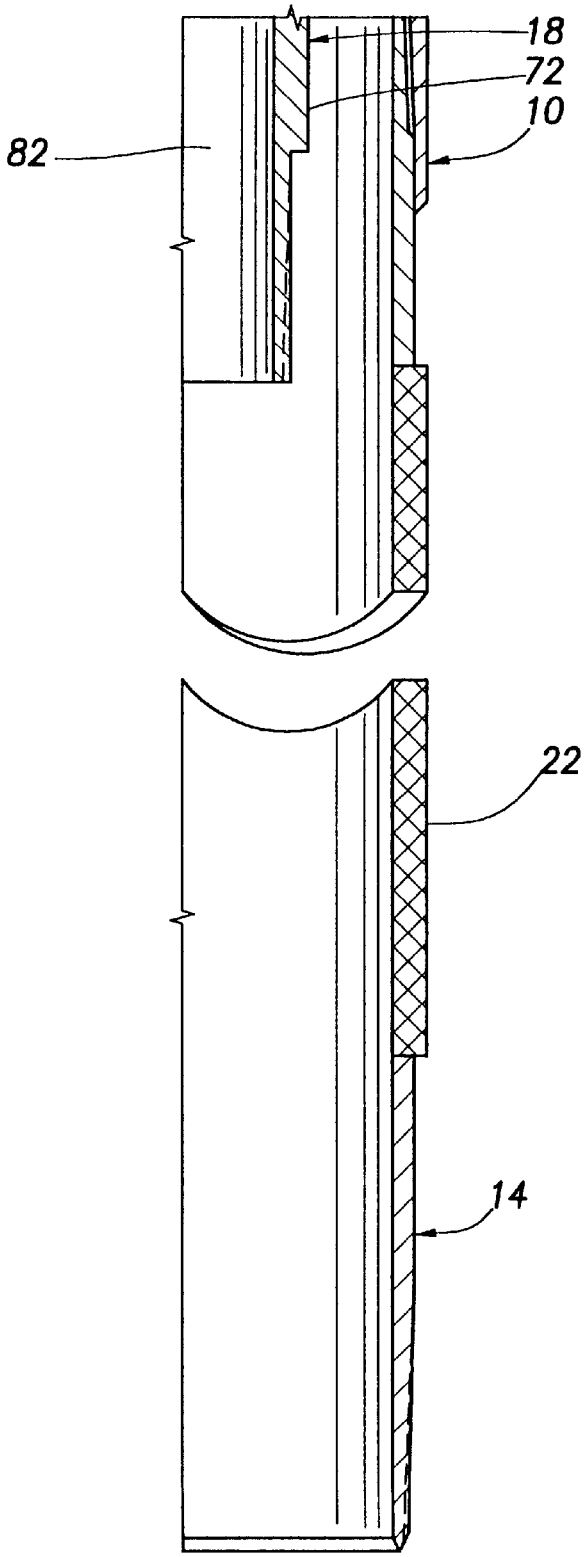

Referring additionally now to FIGS. 4A–4O, the formation fracturing and/or gravel packing assembly 10 is representatively illustrated in a configuration in which the service tool 12 and the upper and lower inner assemblies 16, 18 are permitted to be removed from within the outer assembly 14. A sufficient axially upwardly directed force has been applied to the service tool 12 to shear the shear screw 90, thereby permitting radial retraction of the ring 86 and releasing the lower inner assembly 18 for axial displacement relative to the outer assembly 14.

In this manner, the service tool 12, and upper and lower inner assemblies 16, 18 may be retrieved from the well, while the outer assembly 14 remains sealingly and grippingly engaged with the casing 94. A separate trip into the well is not required to retrieve the washpipe 72, or any other portion of the upper and lower inner assemblies 16, 18.

Thus has been described the formation fracturing and/or gravel packing assembly 10 and associated methods which permit high flow rate formation fracturing and/or gravel packing in large or relatively small diameter wellbores, and which provide a relatively unrestricted, smooth and large diameter slurry flowpath. In addition, these benefits and features are conveniently and economically realized in operation of the assembly 10 and performance of the methods.

Of course, modifications, substitutions, additions, deletions, etc., may be made to the assembly 10, which would be obvious to one of ordinary skill in the art, and these are contemplated by the principles of the present invention. Accordingly, the foregoing detailed description is to be clearly understood as being given by way of illustration and example only, the spirit and scope of the present invention being limited solely by the appended claims.

What is claimed is:

1. Apparatus operatively positionable within a subterranean well, the apparatus comprising:

generally tubular telescopingly configured first and second members, the first member being attachable to a tubing string extending to the earth's surface, and the second member being releasably secured against axial displacement relative to the first member;

a first latching device attached to the second member;

a third generally tubular member axially spaced apart from the first and second members;

a fourth member radially outwardly disposed relative to the second and third members; and a second latching device attached to the third member, the second latching device being configured for cooperative engagement with the first latching device.

2. The apparatus according to claim 1, further comprising a slip member, the slip member preventing axial compression of the first and second members.

3. The apparatus according to claim 2, wherein the slip member permits axial extension of the first and second members.

4. The apparatus according to claim 1, further comprising a receptacle attached to the third member.

5. The apparatus according to claim 4, wherein the receptacle has an internal seal bore formed thereon, the seal bore being configured for receiving a plug therein to thereby prevent fluid flow through an axial bore of the third member.

6. The apparatus according to claim 1, wherein the fourth member includes a port formed through a sidewall portion thereof, and wherein the port is positioned axially between the first and second latching devices.

7. The apparatus according to claim 1, further comprising a packer attached to the fourth member.

8. The apparatus according to claim 1, further comprising a screen attached to the fourth member.

9. The apparatus according to claim 8, further comprising a washpipe attached to the third member, the washpipe being received within the screen.

10. The apparatus according to claim 9, wherein the washpipe is releasably secured within the screen.

11. Apparatus operatively positionable within a subterranean well, the apparatus comprising:

a first assembly including a packer, a generally tubular ported sleeve, and a screen, the ported sleeve being attached axially between the packer and the screen;

a second assembly including multiple coaxially disposed tubular members and a first latching device attached to one of the tubular members, the second assembly being releasably attached to the first assembly; and a third assembly including a washpipe and a second latching device attached to the washpipe, the third assembly being releasably attached to the first assembly, and, wherein the ported sleeve has a port formed through a sidewall portion thereof, the port being disposed between the first and second latching devices.

12. The apparatus according to claim 11, wherein the second assembly is releasably secured against axial displacement relative to the first assembly, and wherein the one of the tubular members is separately releasably secured against axial displacement relative to the first assembly.

13. The apparatus according to claim 11, wherein the third assembly is releasably secured against axial displacement of the washpipe relative to the screen.

14. The apparatus according to claim 11, wherein the tubular members are releasably secured against axial displacement relative to each other.

15. The apparatus according to claim 11, wherein the first assembly includes an internal seal bore disposed axially between a port formed on the ported sleeve and the screen.

16. The apparatus according to claim 15, wherein the third assembly is sealingly engaged with the internal seal bore.

17. The apparatus according to claim 11, wherein the second assembly further includes a slip member, the slip member preventing displacement of the one of the tubular members relative to the other ones of the tubular members in one axial direction.

18. The apparatus according to claim 11, wherein the second assembly is releasably secured against withdrawal from within the first assembly.

19. The apparatus according to claim 11, wherein the third assembly further includes a receptacle attached to the second latching device.

20. The apparatus according to claim 19, further comprising a plug, the plug being sealingly receivable in the receptacle to thereby block fluid flow through the third assembly.

21. The apparatus according to claim 20, wherein the plug is a ball.

22. The apparatus according to claim 20, wherein the plug is releasably positionable in the second assembly to thereby block fluid flow through the second assembly.

23. A method of completing a subterranean well, comprising the steps of:

positioning a generally tubular washpipe assembly axially slidingly within a generally tubular screen;

attaching a ported sleeve to the screen;

releasably securing the washpipe assembly within the screen;

flowing an abrasive slurry through the ported sleeve;

latching onto the washpipe assembly with a tubing string; and removing the washpipe assembly from within the screen.

24. The method according to claim 23, further comprising the steps of positioning the screen within the well, and anchoring the screen therein.

25. The method according to claim 23, further comprising the step of blocking an axial fluid passage formed through the washpipe assembly.

26. The method according to claim 23, further comprising the steps of providing a travel joint as a portion of the tubing string, and axially extending the travel joint.

27. The method according to claim 26, wherein the step of extending the travel joint is performed before the step of latching onto the washpipe assembly.

28. A method of completing a subterranean well, the method comprising the steps of:

providing an apparatus including a first assembly having an interconnected packer, ported sleeve and screen, a second assembly having coaxially slidingly disposed tubular members interconnected to a first latching device, and a third assembly having an interconnected second latching device and washpipe;

positioning the second and third assemblies relative to the first assembly, a flow port of the ported sleeve being disposed axially between the first and second latching devices, and the washpipe being received within the screen;

setting the packer in the well; and flowing a slurry from the earth's surface, through the second assembly, and outward through the flow port.

29. The method according to claim 28, wherein the packer setting step is performed by positioning a plugging device in the second assembly and applying fluid pressure internally to the second assembly.

30. The method according to claim 29, further comprising the step of receiving the plugging device in the third assembly after the step of applying fluid pressure.

31. The method according to claim 28, further comprising the step of displacing the second assembly relative to the first assembly to thereby axially extend the tubular members.

32. The method according to claim 31, wherein the displacing step is performed after the packer setting step.

33. The method according to claim 31, further comprising the step of locking the tubular members in their axially extended configuration.

34. The method according to claim 33, wherein the locking step is performed before the slurry flowing step.

35. The method according to claim 28, further comprising the steps of displacing the second assembly relative to the first assembly and engaging the first latching device with the second latching device.

36. The method according to claim 35, wherein the second assembly displacing step is performed by displacing the second assembly in a first axial direction relative to the first assembly, and further comprising the step of displacing the second assembly relative to the first assembly in a second axial direction opposite to the first axial direction to thereby axially extend the tubular members.

37. The method according to claim 36, wherein the second assembly is displaced in the second axial direction before the step of flowing the slurry, and wherein the second assembly is displaced in the first axial direction after the step of flowing the slurry.

38. The method according to claim 28, further comprising the step of retrieving the second and third assemblies to the earth's surface.

39. The method according to claim 38, wherein the retrieving step is performed while the packer remains set in the well.

40. Apparatus operatively positionable within a subterranean well, the apparatus comprising:

a generally tubular outer assembly including a packer, a circulating sleeve and a screen, the circulating sleeve being interconnected between the packer and the screen;

a generally tubular first inner assembly releasably secured within the outer assembly, the first inner assembly including a washpipe positioned opposite the screen, and the first inner assembly permitting substantially unrestricted fluid flow through the circulating sleeve; and a generally tubular second inner assembly releasably secured within the outer assembly, the second inner assembly permitting substantially unrestricted fluid flow through the circulating sleeve.

41. The apparatus according to claim 40, wherein the first and second inner assemblies are cooperatively engageable with each other and removable from the outer assembly while cooperatively engaged with each other.

42. The apparatus according to claim 40, wherein the second inner assembly includes an axially extendable member, the member being engageable with the first inner assembly, and the first and second inner assemblies being simultaneously removable from within the outer assembly when the member is engaged with the second inner assembly.

* * * * *

UNITED STATES PATENT AND TRADEMARK OFFICE

CERTIFICATE OF CORRECTION

PATENT NO. : 6,053,246

DATED : April 25, 2000

INVENTOR(S) : Ralph H. Echols and Phillip t. Thomas

It is certified that error appears in the above-identified patent and that said Letters Patent is hereby corrected as shown below:

The first name of the inventor "Phillip" T. Thomas has been misspelled. The correct spelling should be -- Phillip --

Signed and Sealed this

Tenth Day of April, 2001

*Attest:*

Nicholas P. Godici

NICHOLAS P. GODICI

*Attesting Officer*

*Acting Director of the United States Patent and Trademark Office*